US006695223B2

(12) United States Patent
Beutler et al.

(10) Patent No.: US 6,695,223 B2
(45) Date of Patent: Feb. 24, 2004

(54) ADJUSTABLE STATOR FOR ROTOR TYPE SPRINKLER

(75) Inventors: Matthew G. Beutler, Temecula, CA (US); Michael L. Clark, San Marcos, CA (US)

(73) Assignee: Hunter Industries, Inc., San Marcos, CA (US)

( * ) Notice: Subject to any disclaimer, the term of this patent is extended or adjusted under 35 U.S.C. 154(b) by 131 days.

(21) Appl. No.: 09/942,399

(22) Filed: Aug. 29, 2001

(65) Prior Publication Data

US 2003/0042327 A1 Mar. 6, 2003

(51) Int. Cl.[7] ..... B05B 15/10

(52) U.S. Cl. ..... 239/201; 239/203; 239/204; 239/207

(58) Field of Search ..... 239/200, 201, 239/203, 204, 205, 206, 207, 569, 570, 571, 580, 581.1, 581.2

(56) References Cited

U.S. PATENT DOCUMENTS

| | | | | |
|---|---|---|---|---|
| 3,584,790 A | | 6/1971 | Bonfield et al. | 239/227 |
| 4,272,025 A | | 6/1981 | Mazzotti | 239/240 |
| 4,543,985 A | * | 10/1985 | Healy et al. | 137/505.25 |
| 4,613,077 A | | 9/1986 | Aronson | 239/97 |
| 4,811,902 A | | 3/1989 | Nagata | 239/240 |
| 4,867,379 A | * | 9/1989 | Hunter | 239/240 |
| 4,892,252 A | | 1/1990 | Bruninga | 239/205 |
| 5,375,768 A | | 12/1994 | Clark | 239/210 |
| 6,050,502 A | | 4/2000 | Clark | 239/237 |
| 6,241,158 B1 | | 6/2001 | Clark | 239/1 |

FOREIGN PATENT DOCUMENTS

| | | |
|---|---|---|
| NZ | 196877 | 4/1923 |

* cited by examiner

*Primary Examiner*—Davis Hwu
(74) *Attorney, Agent, or Firm*—Michael H. Jester

(57) ABSTRACT

An adjustable stator is mounted in the lower end of a pop-up sprinkler riser and includes a vertically extending frame portion and a pair of valve portions that extend horizontally from an upper end of the frame portion. A coil spring is squeezed between a lower end of a drive subassembly and a mandrel mounted in a lower end of the frame portion. The mandrel and the frame portion have mating projections which allow the vertical position of the mandrel to be adjusted. This adjusts the downward biasing force exerted by the coil spring against the frame portion and the valve members carried thereby. This varies the pressure of a water stream flowing past a turbine in the riser, and the speed of rotation of the turbine which in turn changes the speed of rotation of a nozzle driven by the turbine.

16 Claims, 42 Drawing Sheets

ADJUSTABLE STATOR FOR ROTOR TYPE SPRINKLER

FIELD OF THE INVENTION

The present invention relates to irrigation equipment, and more particularly, to sprinklers of the type that use internal turbines to rotate a nozzle to distribute water over turf or other landscaping.

BACKGROUND OF THE INVENTION

Many regions of the world have inadequate rainfall to support lawns, gardens and other landscaping during dry periods. Sprinklers are commonly used to distribute water over such landscaping in commercial and residential environments. The water is supplied under pressure from municipal sources, wells and storage reservoirs.

So called "hose end" sprinklers were at one time in widespread use. As the name implies, they are devices connected to the end of a garden hose for ejecting water in a spray pattern over a lawn or garden. Fixed spray head sprinklers which are connected to an underground network of pipes have come into widespread use for watering smaller areas.

Impact drive sprinklers have been used to water landscaping over larger areas starting decades ago. They are mounted to the top of a fixed vertical pipe or riser and have a spring biased arm that oscillates about a vertical axis as a result of one end intercepting a stream of water ejected from a nozzle. The resultant torque causes the nozzle to gradually move over an adjustable arc and a reversing mechanism causes the nozzle to retrace the arc in a repetitive manner.

Rotor type sprinklers pioneered by Edwin J. Hunter of Hunter Industries, Inc. have largely supplanted impact drive sprinklers, particularly on golf courses and playing fields. Rotor type sprinklers are quieter, more reliable and distribute a more precise amount of precipitation more uniformly over a more accurately maintained sector size.

A rotor type sprinkler typically employs an extensible riser which pops up out of a fixed outer housing when water pressure is applied. The riser has a nozzle in a rotating head mounted at the upper end of the riser. The riser incorporates a turbine which drives the rotating head via a gear train reduction, reversing mechanism and arc adjustment mechanism. The turbine is typically located in the lower part of the riser and rotates about a vertical axis at relatively high spend. Some rotor type sprinklers have an arc return mechanism so that if a vandal twists the riser outside of its arc limits, it will resume oscillation between the arc limits to prevent sidewalks, people and buildings from being watered. Rotor type sprinklers used on golf courses sometimes include an ON/OFF diaphragm valve in the base thereof which is pneumatically or electrically controlled.

On occasion it would be desirable for a rotor type sprinkler to rotate its nozzle much more rapidly than during normal irrigation. For example, a higher than normal nozzle rotation speed may be desirable for dust control, washing of chemicals from turf and plants, and the protection of vegetation from near freezing or freezing conditions. A quick application of water via high speed rotation of the nozzle is an acceptable way to accomplish these beneficial results. Conventional sprinklers are typically manufactured with a predetermined rotational speed so the user is forced to buy one speed or the other.

SUMMARY OF THE INVENTION

It is therefore the primary object of the present invention to provide a rotor type sprinkler with a variable stator for changing the rotational speed of the nozzle.

It is another object of the present invention to provide a rotor type sprinkler with a user adjustable nozzle speed.

According to the present invention a sprinkler includes an outer housing having a lower end connectable to a source of pressurized water. A riser is vertically reciprocable along a vertical axis within the outer housing between extended and retracted positions when the source of pressurized water is turned ON and OFF. A nozzle is mounted at an upper end of the riser for rotation about the vertical axis. A turbine is mounted inside the riser for rotation at different speeds in response to changes in pressure of the water flowing past the turbine. A drive mechanism is mounted within the riser and connects the turbine and the nozzle for rotating the nozzle. An adjustable stator changes the pressure of the water flowing past the turbine to vary the speed of rotation of the nozzle.

DESCRIPTION OF THE PREFERRED EMBODIMENT

Figure 4:
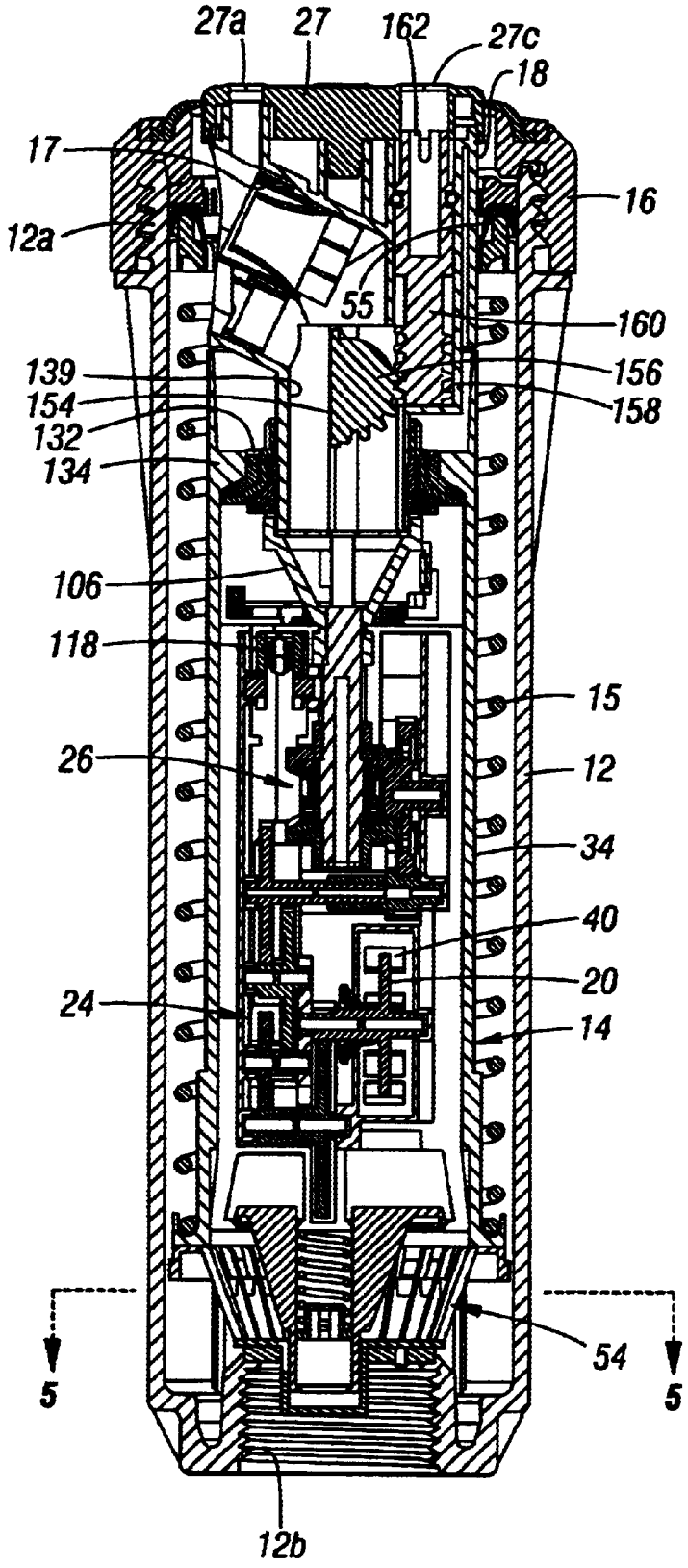
FIG. 4 is a vertical sectional view of the sprinkler taken along line 4—4 of FIG. 3.
Figure 6:
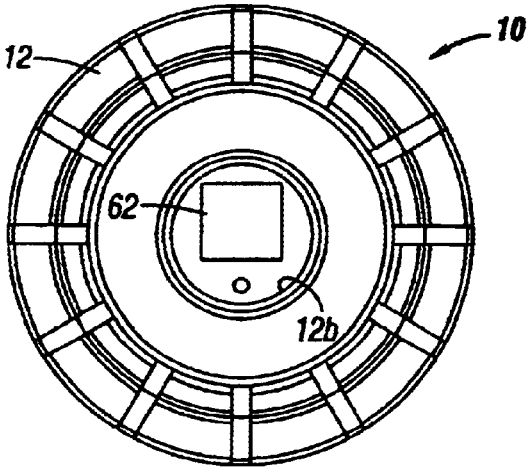
FIG. 6 is a bottom plan view of the sprinkler taken from the lower end of FIG. 1.
Figure 80:
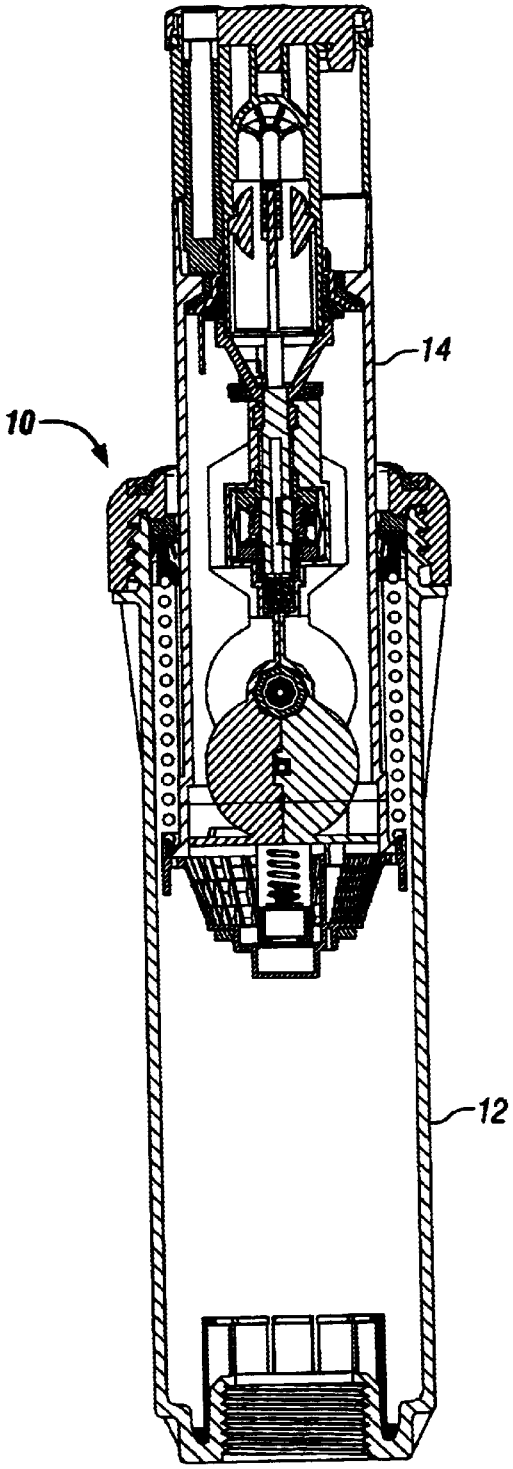
FIGS. 80 and 81 are vertical sectional views of the sprinkler of FIG. 1 similar to FIGS. 2 and 4, respectively, illustrating the riser in its extended and retracted positions.
Figure 81:
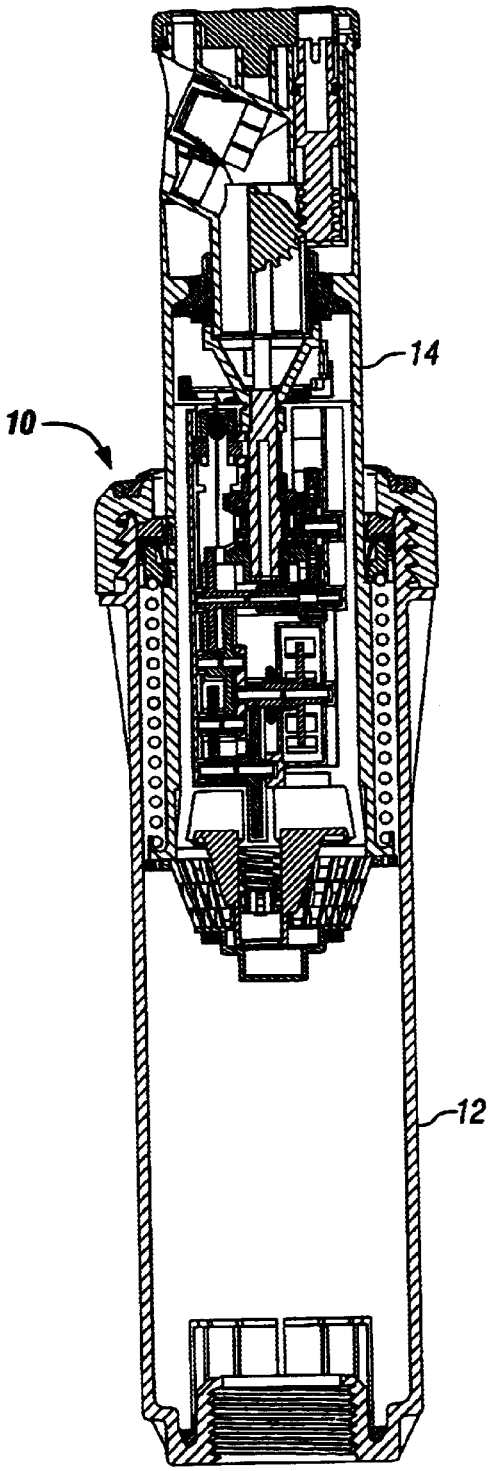

In accordance with the present invention, a pop-up rotor type sprinkler 10 (FIG. 1) includes an outer cylindrical housing 12 having a lower end connectable to a source of pressurized water (not illustrated) and an inner cylindrical riser 14 (FIGS. 11–15) that is vertically reciprocable along a vertical axis within the outer housing 12 between extended and retracted positions when the source of pressurized water is turned ON and OFF. The retracted or lowered position of the riser 14 is illustrated in FIGS. 2 and 4. The extended or raised position of the riser 14 is illustrated in FIGS. 80 and 81. The sprinkler 10 is normally buried in the ground with its upper end level with the surface of the soil. The riser 14 pops up to spray water on the surrounding landscaping in response to commands from an electronic irrigation controller that turn a solenoid actuated water supply valve ON in accordance with a water program previously entered by a homeowner or by maintenance personnel. When the irrigation controller turns the solenoid OFF, the flow of pressurized water to the sprinkler 10 is terminated and the riser retracts so that it will not be unsightly and will not be an obstacle to persons walking or playing at the location of the sprinkler 10, or to a mower.

Figure 2:
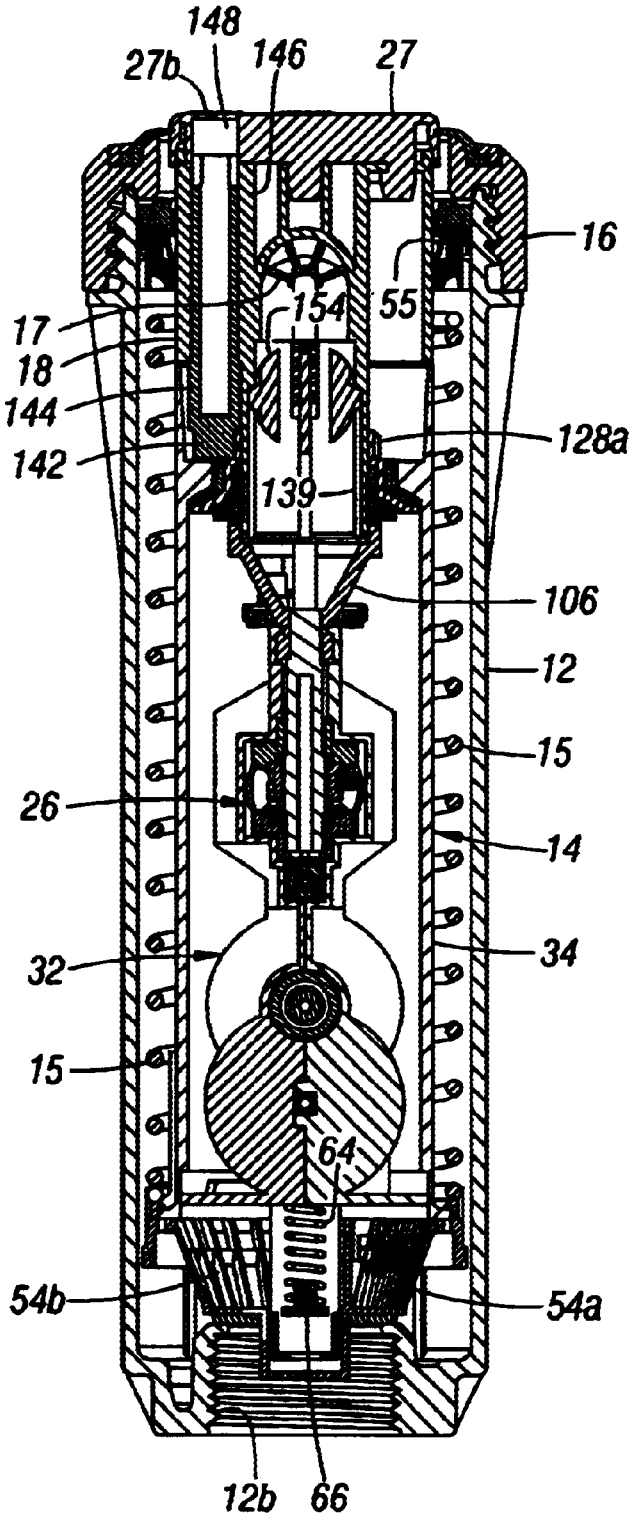
FIG. 2 is a vertical sectional view of the sprinkler taken along line 2—2 of FIG. 1.
Figure 3:
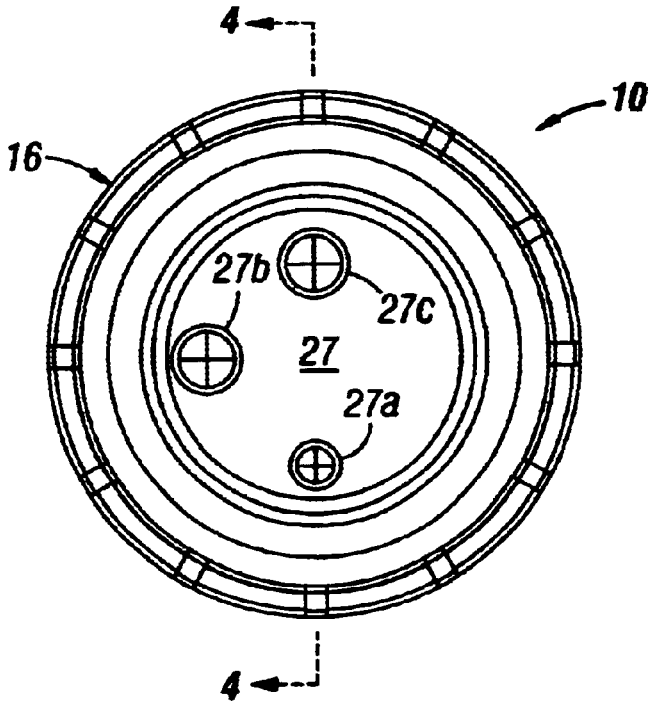
FIG. 3 is a top plan view of the sprinkler taken from the upper end of FIG. 1.
Figure 5:
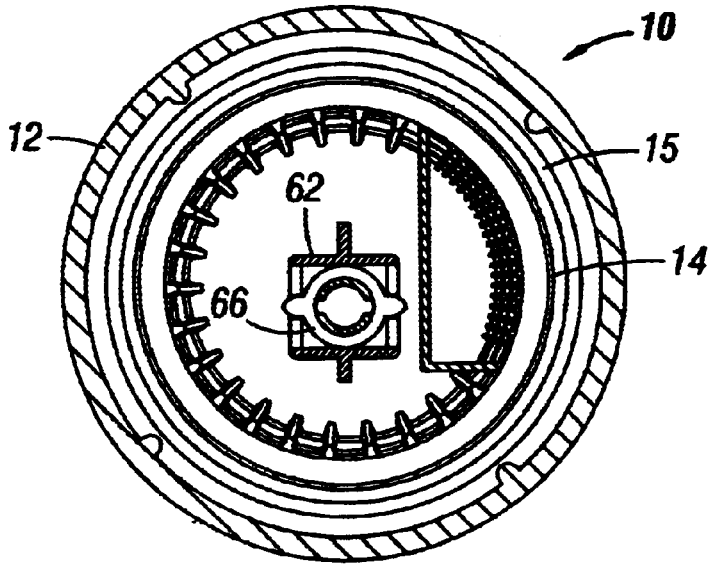
FIG. 5 is a horizontal sectional view of the sprinkler taken along line 5—5 of FIG. 4.

The riser 14 (FIGS. 2 and 3) is biased to its retracted position by a large coil spring 15 that surrounds the riser 14. The lower end of the coil spring 15 is retained by a flange 14*a* (FIG. 4) formed on the lower end of the riser 14. The upper end of the coil spring 15 is retained by a female threaded cap 16 that screws over a male threaded exterior segment 12*a* (FIG. 4) at the upper end of the outer housing 12. A pair of containment rings are positioned below the cap 16 that are separated by a flexible seal 55 (FIGS. 2 and 4). A nozzle 17 is mounted in a rotatable head or turret 18 (FIGS. 11–15) at an upper end of the riser 14 for rotation about a vertical axis.

Figure 9:
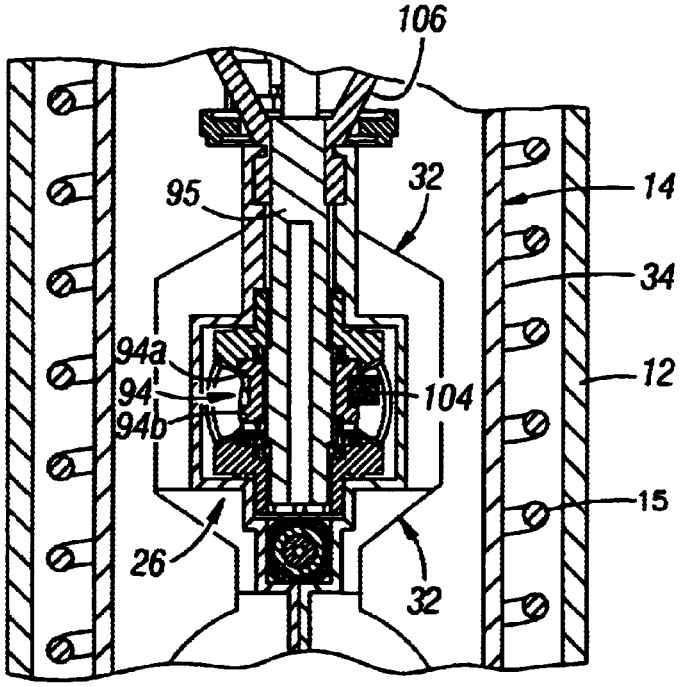
FIG. 9 is a greatly enlarged fragmentary portion of FIG. 2 showing details of the reversing mechanism of the sprinkler.
Figure 10:
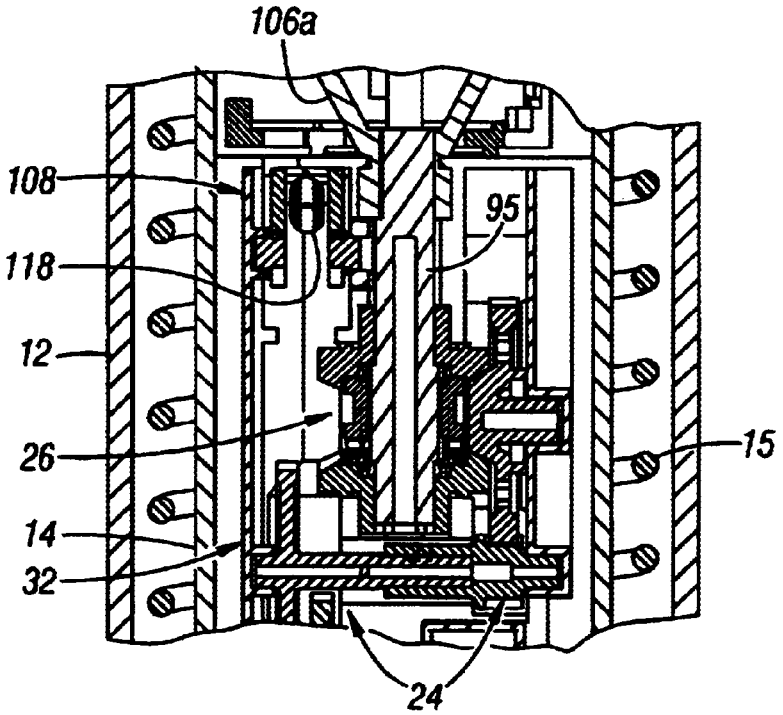
FIG. 10 is a greatly enlarged fragmentary portion of FIG. 4 showing further details of the reversing mechanism of the sprinkler.
Figure 11:
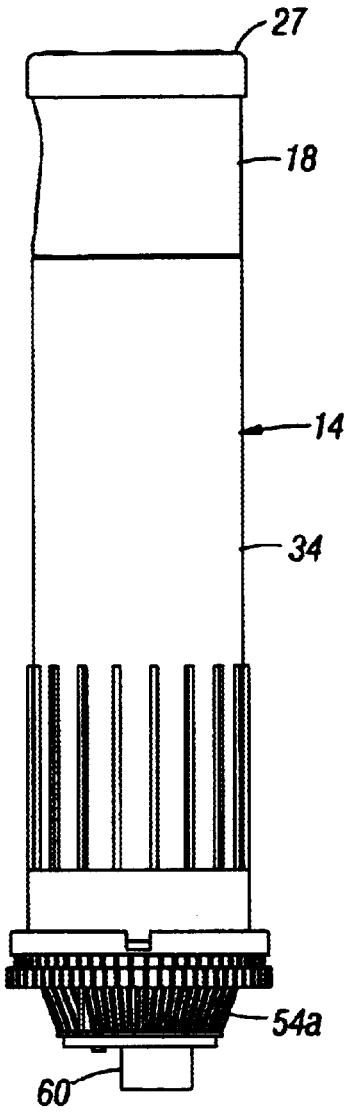
FIG. 11 is a side elevation view of the riser of the sprinkler of FIG. 1.
Figure 12A:
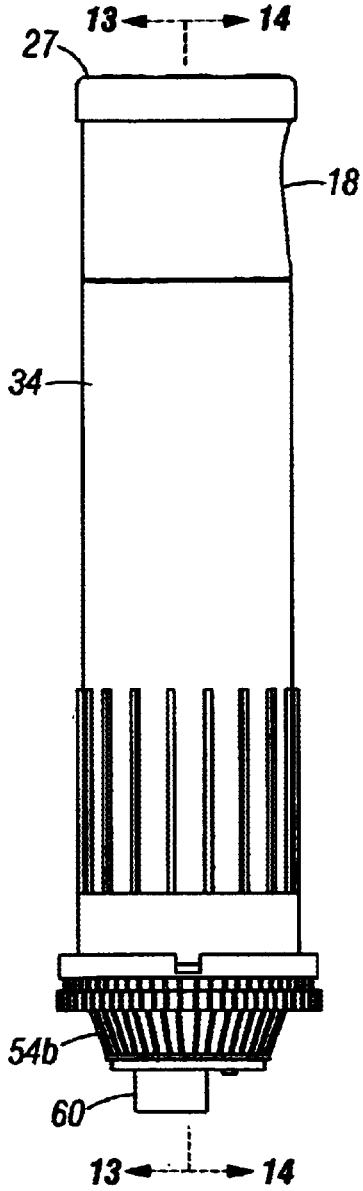
FIG. 12A is a side elevation view of the riser rotated one hundred and eighty degrees relative to FIG. 11.
Figure 12B:
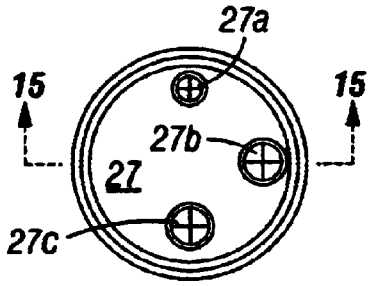
FIG. 12B is a top plan view of the riser of FIG. 12A.

A turbine 20 (FIGS. 4 and 22) is mounted inside the riser 14 for rotation about a horizontal axis, as distinguished from the vertical axis. A drive mechanism hereafter described in detail connects the turbine 20 to the turret 18 containing the nozzle 17 so that when the source of pressurized water is turned ON the resulting rotation of the turbine 20 by the pressurized water will rotate the nozzle 17 about the vertical axis. The turbine 20 drives a gear train reduction 24 (FIG. 15) that in turn drives a reversing mechanism 26 (FIG. 9).

Except for the various springs and axles and the elastomeric components specifically identified, the components of the sprinkler 10 are made of injection molded thermoplastic material.

The outer housing 12, the inner housing 14, and the cap 16 are preferably molded of UV resistant black colored ABS plastic. A cap member 27 (FIGS. 2–4 and 13) covers the upper end of the turret 18. The cap member 27 is molded of a UV resistant black colored elastomeric material and has three cross-hair slits 27*a,* 27*b* and 27*c* (FIG. 3) through which the shaft of a conventional HUNTER® hand tool may be inserted to raise and lower a flow stream interrupter, adjust one of the arc limits or actuate a flow stop valve.

Figure 18:
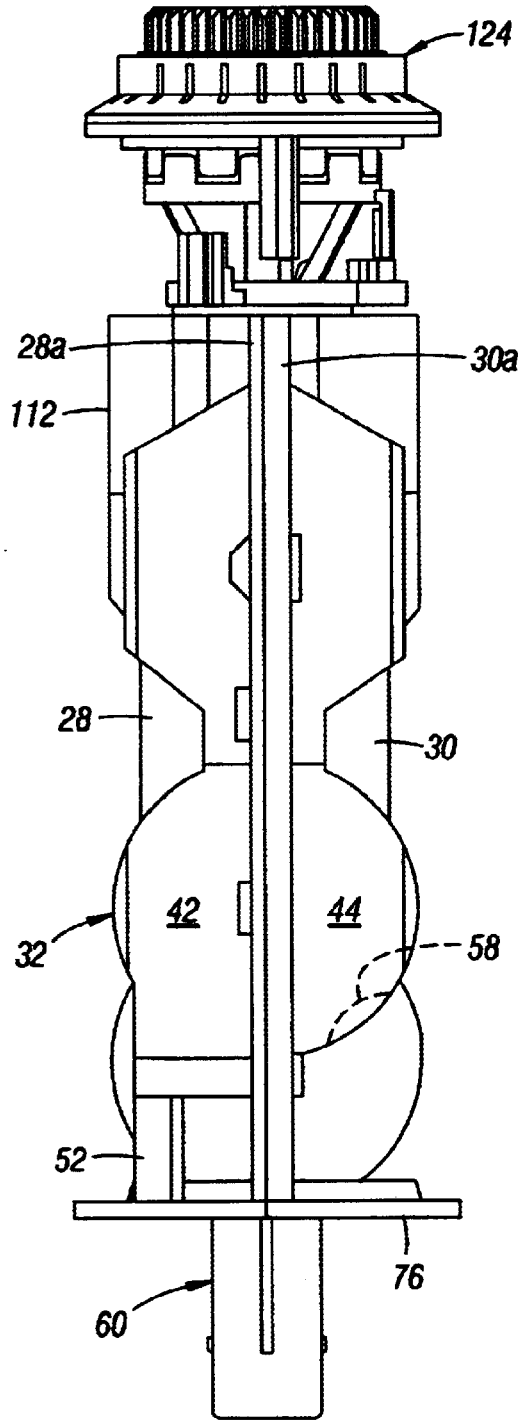
FIG. 18 is a side elevation view of the drive subassembly, shift disk and turret coupling assembly of the sprinkler of FIG. 1.
Figure 19:
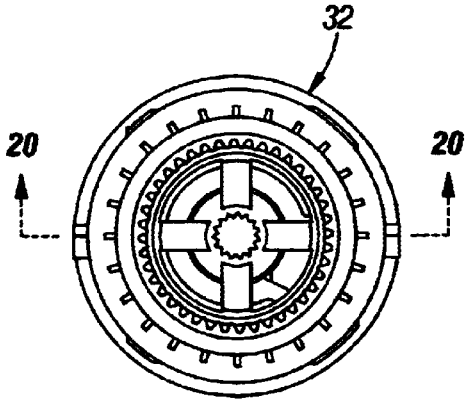
FIG. 19 is a top plan view of the turret coupling assembly taken from the upper end of FIG. 18.

The turbine 20, gear train reduction 24 and reversing mechanism 26 are assembled inside one of two case members 28 and 30 to form a self-contained drive subassembly 32 (FIGS. 25–30). The case members 28 and 30 extend vertically and form opposite halves of a hollow container. The case members 28 and 30 are joined together along planar abutting peripheral flanges such as 28*a* and 30*a* visible in FIG. 18 before being inserted into the cylindrical inner housing 34 that forms the exterior of the riser 14. The case members 28 and 30 may be joined by sonic welding, adhesive, or other suitable means once the drive mechanisms mounted therein have been tested and found to be fully operative.

The importance of the architecture of the drive subassembly 32 will not be lost on those familiar with the manufacture of rotor type sprinklers. The turbine 20, as well as the axles and the tiny spur and pinion gears of the gear train reduction 24 and the reversing mechanism 26, and their related linkages, can be automatically or manually laid in place inside corresponding slots and depressions molded into the case member 28 when laid flat with its open side facing upwardly. The other case member 30 can then be snapped in place, with the aid of mating projections and detents, over the case member 28. The drive mechanisms inside the drive subassembly 32 can then be tested on the assembly line and the case members 28 and 30 can be snapped apart to replace any defective components or fix any jams. Once the drive mechanisms have been tested and shown to be functional on the assembly line, the case members 28 and 30 can be permanently joined in claim shell arrangement and slid into the inner cylindrical housing 34 of the riser 14. This is a greatly advantageous arrangement to that employed in conventional rotor type sprinklers in which a free-standing vertical stack of tiny gears and other drive components must be assembled in tedious fashion and inserted into the riser, from which they cannot be easily removed for repair. Also, as will be apparent from the drawings and accompanying description, the parts count in the sprinkler 10 is significantly less than that of conventional arc adjustable rotor type sprinklers.

Figure 22:
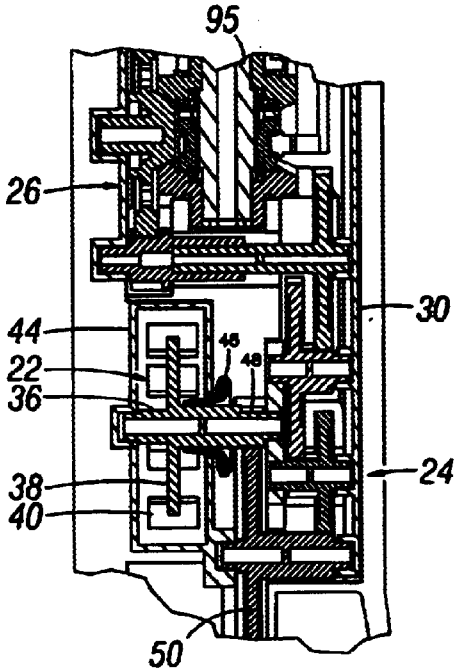
FIG. 22 is a greatly enlarged fragmentary portion of FIG. 20 showing further details of the turbine, gear train reduction, reversing clutch and driven bevel gears of the drive subassembly.

The turbine 20 (FIGS. 4, 15, 20 and 22) is a Pelton type turbine that includes a central cylindrical hollow shaft 36 (FIG. 22), a disc 38 and a plurality of equally circumferentially spaced cups or buckets 40 formed on the periphery of the disc 38. The buckets 40 each have an identical wedge shape that includes a beveled or sharp leading edge and a hollow, rearwardly facing opening against which a stream of water is directed. The turbine 20 is mounted for high speed rotation within mating annular housing portions 42 and 44 (FIG. 18) of the case members 28 and 30, respectively. The cylindrical hollow shaft 36 of the turbine 20 is mounted in a bearing 46 (FIG. 22). A pinion gear 48 formed on one end of the shaft 36 engages and drives a spur gear 50 forming part of the gear train reduction 24. The bearing 46 also functions as a seal to prevent a continuous flow of water from the turbine housing formed by the housing portions 42 and 44 into the hollow portions between the case members 28 and 30 that enclose the gear train reduction 24 and the bevel gear reversing mechanism 26. These areas fill up with water since the case members 28 and 30 are not hermetically sealed together. However, there is no continuous flow of water through the areas of the drive subassembly 32 containing the gear train reduction 24 and the reversing mechanism 26 that could carry grit to these sensitive mechanisms and cause them to fail.

Figure 7:
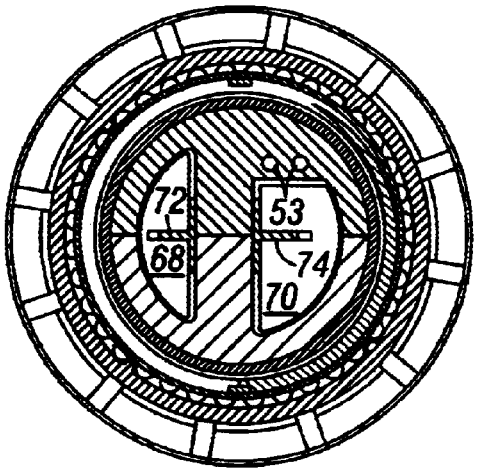
FIG. 7 is a horizontal sectional view of the sprinkler taken along line 7—7 of FIG. 1.

A vertically elongated rectangular hollow chute 52 (FIG. 18) provides a water flow path to a pair of inlet holes 53 (FIG. 7) to the housing portion 42 for directing a stream of water against the hollow rearward facing sides of the buckets 40 of the Pelton turbine 20. The chute 52 extends tangentially to the outer circumference of the turbine 20 for maximum efficiency in directing the stream of water that flows through same to impart rotation to the turbine 20. Pressurized water enters the cylindrical outer housing 12 through its female threaded lower inlet 12*b* (FIG. 4) and passes through a frusto-conical screen or strainer 54. A first portion of this water then passes a finer mesh section 54*a* of the strainer 54 and then through the chute 52 (FIG. 18) and the inlet holes 53 (FIG. 7) and drives the turbine 20.

A second portion of the water flows through a coarser mesh section 54*b* of the strainer 54 and then vertically through the space 56 (FIG. 14) between the exterior of the drive subassembly 32 and the cylindrical inner housing 34 of the riser 14 and out the nozzle 17. The first portion of water that drives the turbine 20 passes out of the drive subassembly 32 through a round outlet aperture 58 (FIG. 18) in a lower part of the periphery of the annular housing portion 44. The outlet aperture 58 is illustrated in phantom lines in FIG. 18. The first portion of the water exiting the outlet aperture 58 joins the upwardly flowing second portion flowing through the space 56 (FIG. 14) and ultimately exits the riser 14 via the nozzle 17 along with the second portion of the water. Less than five percent of the water flowing through the sprinkler 10 actually drives the turbine 20. The remainder flows directly to the nozzle 17 via the space 56 between the drive subassembly 32 and the inner housing 34. Since the bulk of the water never reaches or comes into contact with the sensitive mechanisms inside the drive subassembly 32 it need only be coarsely filtered, and the reach of the stream of water ejected from the nozzle 17 is maximized.

Our sprinkler 10 advantageously divides the water that flows into the riser 14 into two different portions and subjects them to different levels of filtering. A first portion that enters the drive subassembly 32 must pass through a finer mesh section 54*a* (FIG. 2) of the strainer 54 than the second portion. The second portion of the water only flows around the drive subassembly 32 and therefore only passes through a coarser mesh section 54*b* of the strainer 54. The mesh sections 54*a* and 54*b* represent separate filters for different portions of the water inflow. The water that comes into contact with the delicate turbine 20 is subject to more intensive filtering than the water that only flows around the drive assembly 32. However, it is still necessary to subject the water that bypasses the turbine 20 to some degree of filtering to protect, for example, the smallest orifice in the nozzle 17.

The self-contained clam shell drive subassembly 32 of our sprinkler 10 is advantageously suited for assembly line production. The Pelton turbine 20, the various gears of the gear train reduction 24, the parts of the reversing mechanism 26, as well as various additional mechanisms hereafter described can be manually or automatically laid into the corresponding recesses and compartments formed in a first one of the two case members 28 and 30 when it is laid horizontal. The second case member can then be snapped into place over the first case member. The completed drive subassembly 32 can then be inserted into the inner cylindrical housing 34 of the riser 14.

Figure 51:
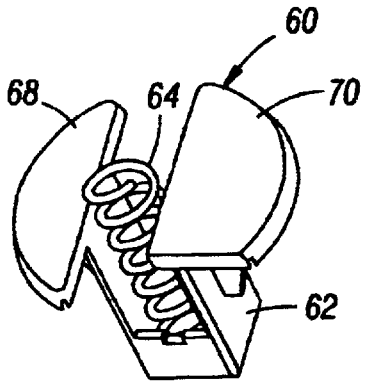
FIG. 51 is an enlarged perspective view taken from the upper end of the valve member and spring of the adjustable stator.
Figure 53:
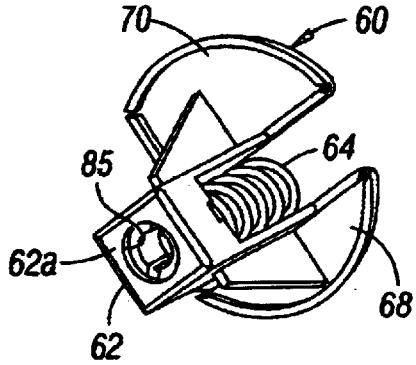
FIG. 53 is an enlarged perspective view taken from the lower end of the valve member and spring of the adjustable stator.

On occasion it would be desirable for the sprinkler 10 to rotate its nozzle 17 much more rapidly than during normal irrigation. For example, a higher than normal nozzle rotation speed may be desirable for dust control, washing of chemicals from turf and plants, and the protection of vegetation from near freezing or freezing conditions. A quick application of water via high speed rotation of the nozzle 17 is an acceptable way to accomplish these beneficial results. The sprinkler 10 incorporates a manually adjustable stator 60 (FIGS. 50–57) that is mounted to the lower end of the riser 14, directly beneath the drive subassembly 32 for varying a nominal rotational speed of the turbine 20 for an expected water pressure. The stator 60 includes a vertical central box-like frame portion 62 that encloses a coil spring 64. The lower end of the spring 64 surrounds a cylindrical mandrel 66 (FIG. 56) seated on the bottom wall of the frame portion 62. The upper end of the coil spring 64 is constrained by a stop described hereafter. Spaced apart flat valve members 68 and 70 (FIGS. 51 and 57) extend horizontally from the upper end of the frame portion 62 and are reinforced by triangular ribs 72 and 74 (FIG. 55), respectively. The spring biased valve members 68 and 70 of the adjustable stator 60 slide up and down relative the lower end plate 76 (FIGS. 14 and 18) of the drive subassembly 32 in a manner that has the effect of changing the pressure of the first portion of the water that drives the turbine 20. This results in a change in the speed of rotation of the turbine 20.

Figure 52:
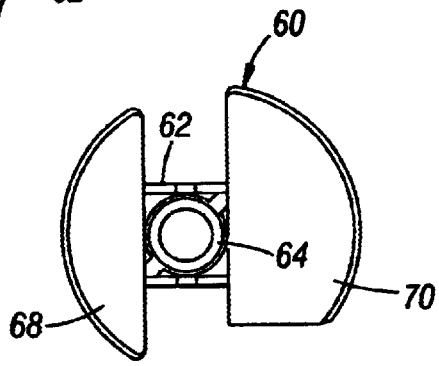
FIG. 52 is an enlarged top plan view of the valve member and spring of the adjustable stator.
Figure 54:
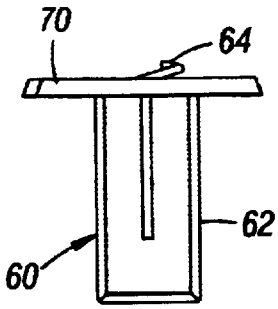
FIG. 54 is an enlarged side elevation view of the valve member of the adjustable stator.
Figure 55:
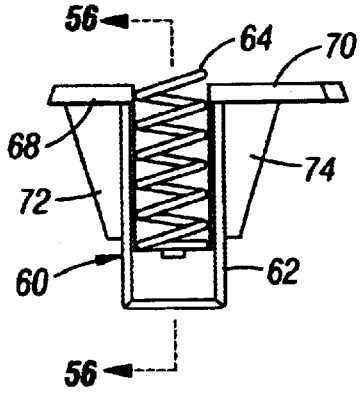
FIG. 55 is an enlarged side elevation view of the valve member and spring of the adjustable stator rotated ninety degrees from its position illustrated in FIG. 54.
Figure 56:
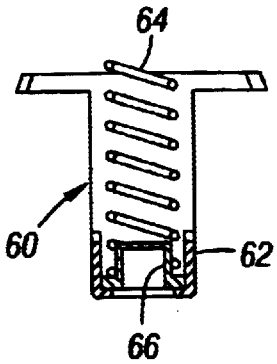
FIG. 56 is an enlarged vertical sectional view of the valve member and spring of the adjustable stator taken along line 56—56 of FIG. 55.
Figure 57:
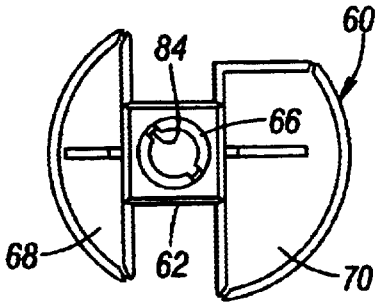
FIG. 57 is an enlarged bottom plan view of the valve member of the adjustable stator taken from the lower end of FIG. 55.
Figure 58:
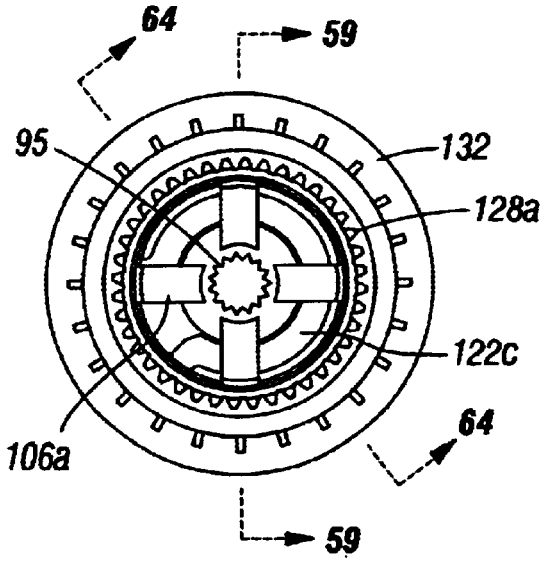
FIG. 58 is top plan view of the turret coupling assembly of the sprinkler of FIGS. 1, 2 and 4 taken from the top of FIG. 62.
Figure 59:
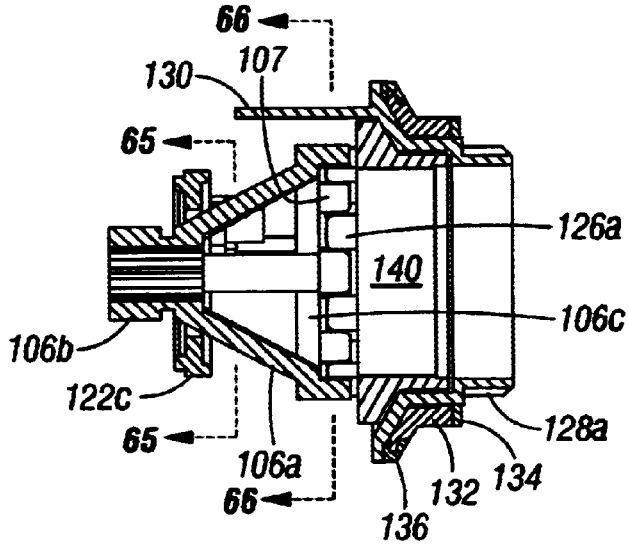
FIG. 59 is a vertical sectional view of the turret coupling assembly taken along line 59—59 of FIG. 58.
Figure 60:
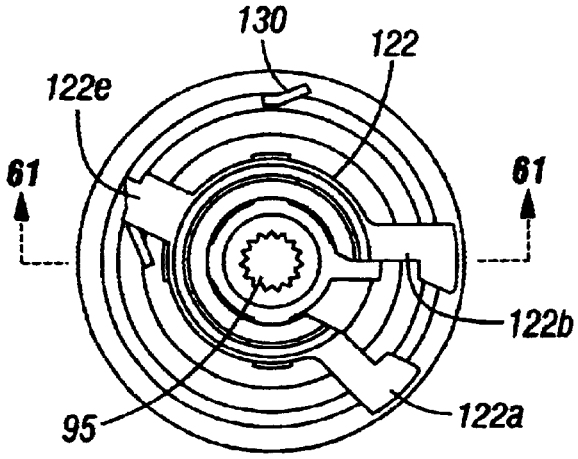
FIG. 60 is a horizontal sectional view taken along line 60—60 of FIG. 70 illustrating further details of the turret coupling assembly and illustrating the shift disk that cooperates with the turret coupling assembly.
Figure 61:
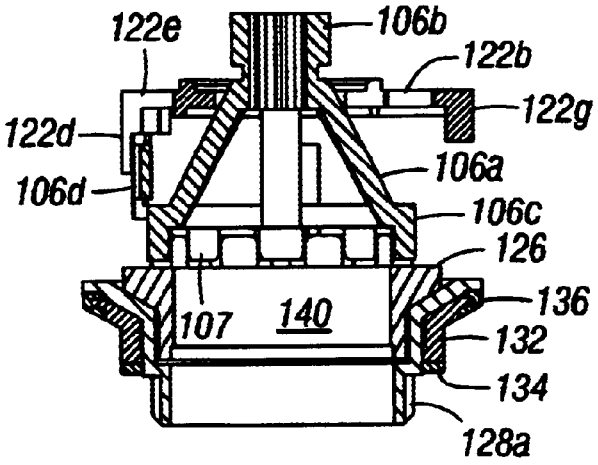
FIG. 61 is an inverted vertical sectional view through the turret coupling assembly and shift disk taken along line 61—61 of FIG. 60.
Figure 62:
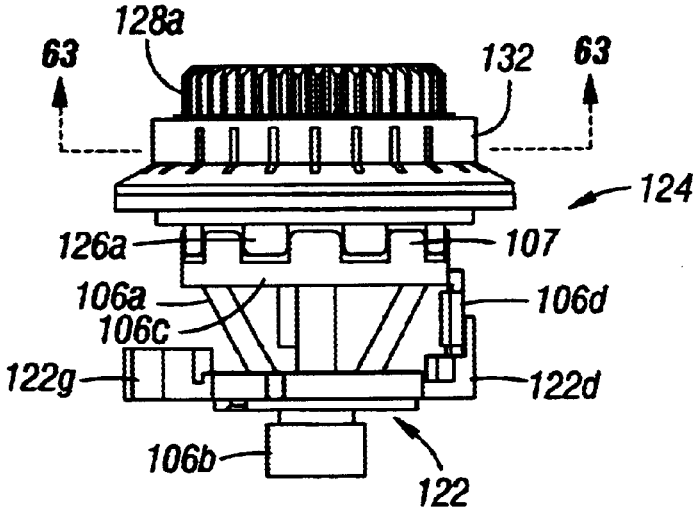
FIG. 62 is a side elevation view of the turret coupling assembly and shift disk.
Figure 63:
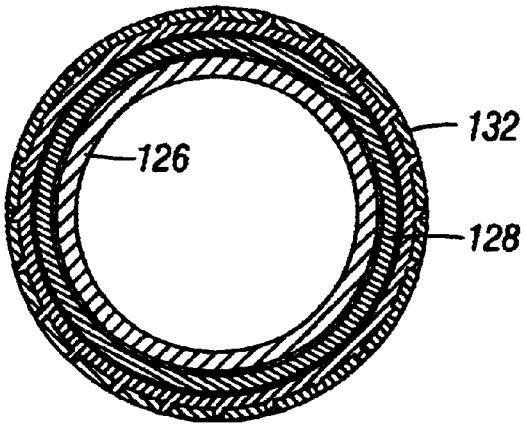
FIG. 63 is a vertical sectional view of the turret coupling assembly taken along line 63—63 of FIG. 62.

As best seen in FIG. 52, the valve members 68 and 70 each have an arcuate outer contour and a straight edge. The straight edges of the valve members 68 and 70 oppose one another and are spaced apart a sufficient distance to allow the coil spring 64 to extend therethrough as illustrated in FIGS. 55 and 56. One end of the valve member 70 is truncated as best seen in FIGS. 52 and 57. The area of the valve member 68 is smaller than the area of the valve member 70. The valve members 68 and 70 are each generally planar and have turned down edges on the curved outer contours.

Figure 15:
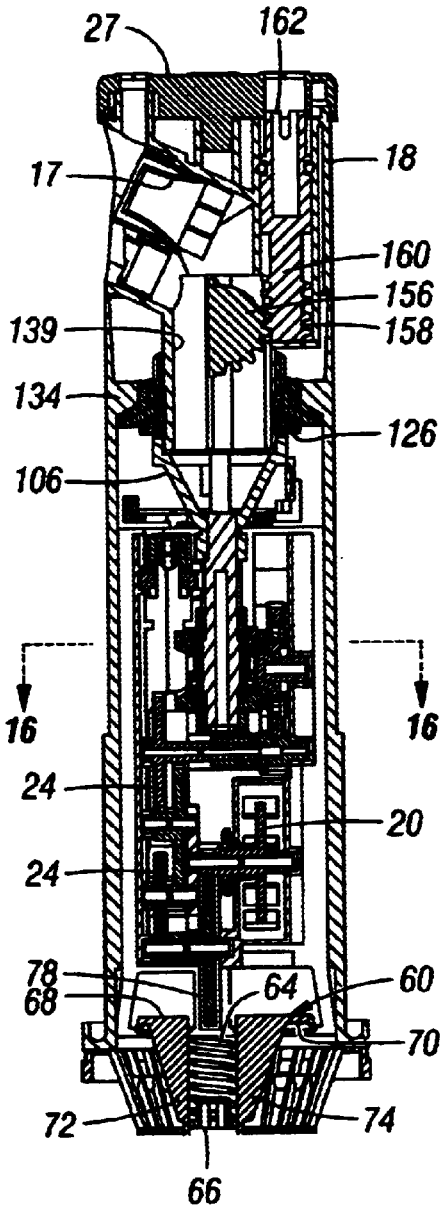
FIG. 15 is a vertical sectional view of the riser taken along line 15—15 of FIG. 12B.
Figure 16:
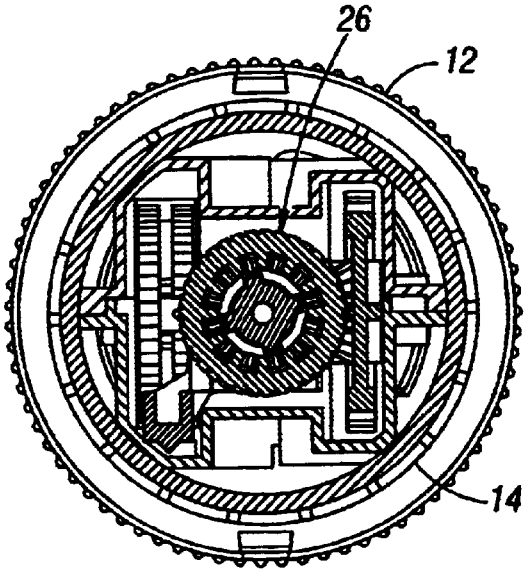
FIG. 16 is a horizontal sectional view of the riser taken along line 16—16 of FIG. 15.
Figure 17:
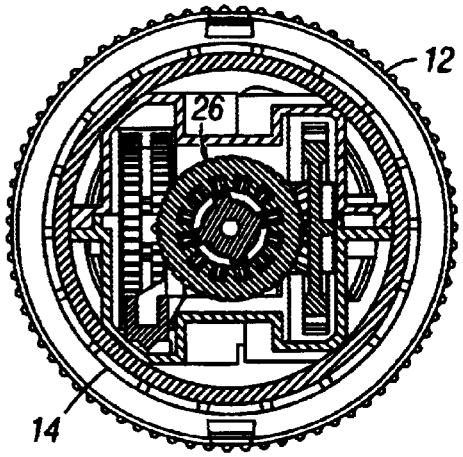
FIG. 17 is a greatly enlarged version of FIG. 16.
Figure 20:
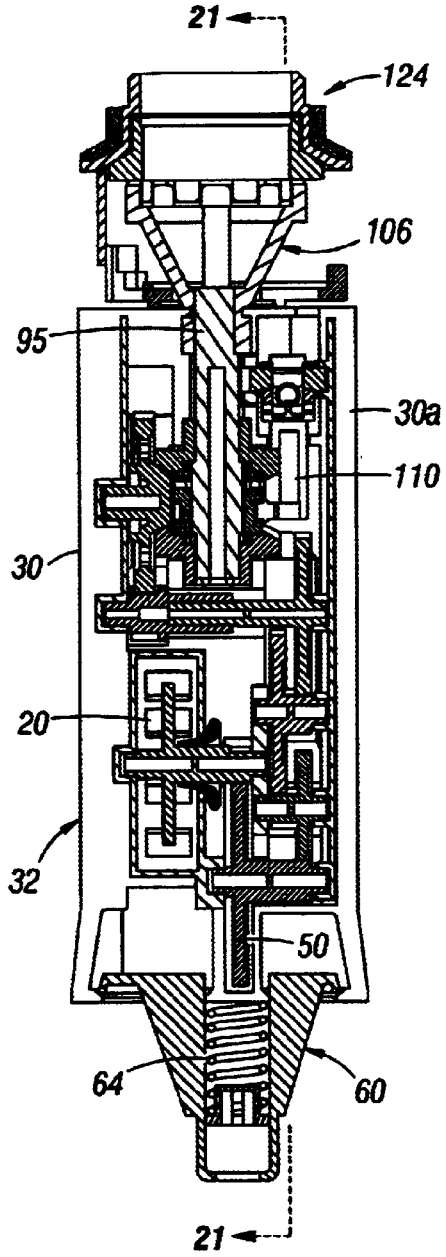
FIG. 20 is a vertical sectional view of the drive subassembly, shift disk and turret coupling assembly taken along line 20—20 of FIG. 19.

The mounting of the adjustable stator 60 within the drive subassembly 32 is illustrated in FIGS. 15 and 20. The upper end of the coil spring 64 presses against the disc-shaped housing portion 78 of the drive subassembly 32 that encloses the spur gear 50 of the gear train reduction 24. The disc-shaped portion 78 serves as a vertical guide piece for the stator 60. The sides of the disc-shaped portion 78 engage the vertical side walls of the frame portion 62 as best seen in FIG. 15. The lower end of the housing portion 78 also provides a stop for the upper end of the coil spring 64. The horizontal valve members 68 and 70, and their supporting ribs 72 and 74 slide up and down relative to the end plate 76 on either side of the disc-shaped housing portion 78. The lower end plate 76 of the drive subassembly 32 is formed with a pair of apertures 80 and 82 (FIG. 27) that are complementary in shape, and aligned with, the valve members 68 and 70.

The vertical position of the cylindrical mandrel 66 is adjustable by placing the tip of a screwdriver or other tool (not illustrated) in a diametric slot 84 (FIG. 57) formed in the lower end of the mandrel 66. The screwdriver can be inserted through a round hole 85 formed in the bottom wall 62*a* (FIG. 53) of frame portion 62 of the adjustable stator 60. The screwdriver is twisted to unlock mating detents and projections (not illustrated) formed on the mandrel 66 and the lower end of the frame portion 62. This allows the mandrel 66 to be moved to one of a plurality of predetermined vertical positions within the frame portion 62 where it can be twisted again and locked into a new position. This adjusts the downward biasing force exerted by the coil spring 64 against the against the frame portion 62 and the valve members 68 and 70 carried thereby. This changes the pressure of the first portion of the water entering the threaded lower inlet 12*b* that forms a stream of water that drives the turbine 20, thereby varying the speed of rotation of the turbine 20. Changing the speed of rotation of the turbine 20 changes the speed of rotation of the nozzle 17 a commensurate amount. In order to adjust the speed of rotation of the nozzle 17 it is necessary to unscrew the threaded lower inlet 12*b* of the sprinkler 10 from its male fitting (not illustrated) so that a screwdriver can be inserted into the inlet 12*b* to engage the diametric slot 84 in the mandrel 66 with a screwdriver to twist the mandrel 66 and adjust its height.

Figure 33:
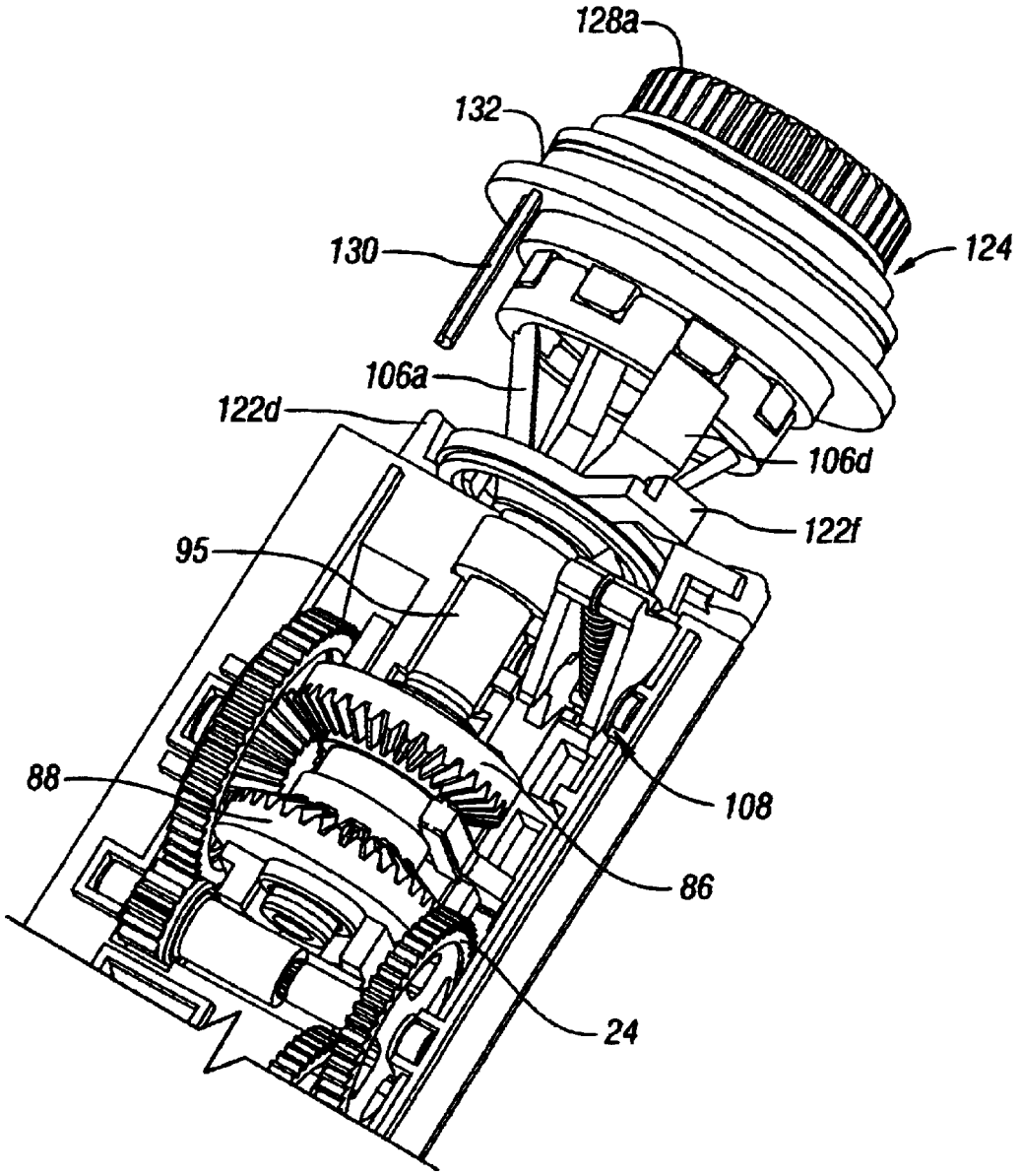
FIG. 33 is an enlarged, fragmentary perspective view of the upper portion of the drive subassembly and the turret coupling assembly.
Figure 34:
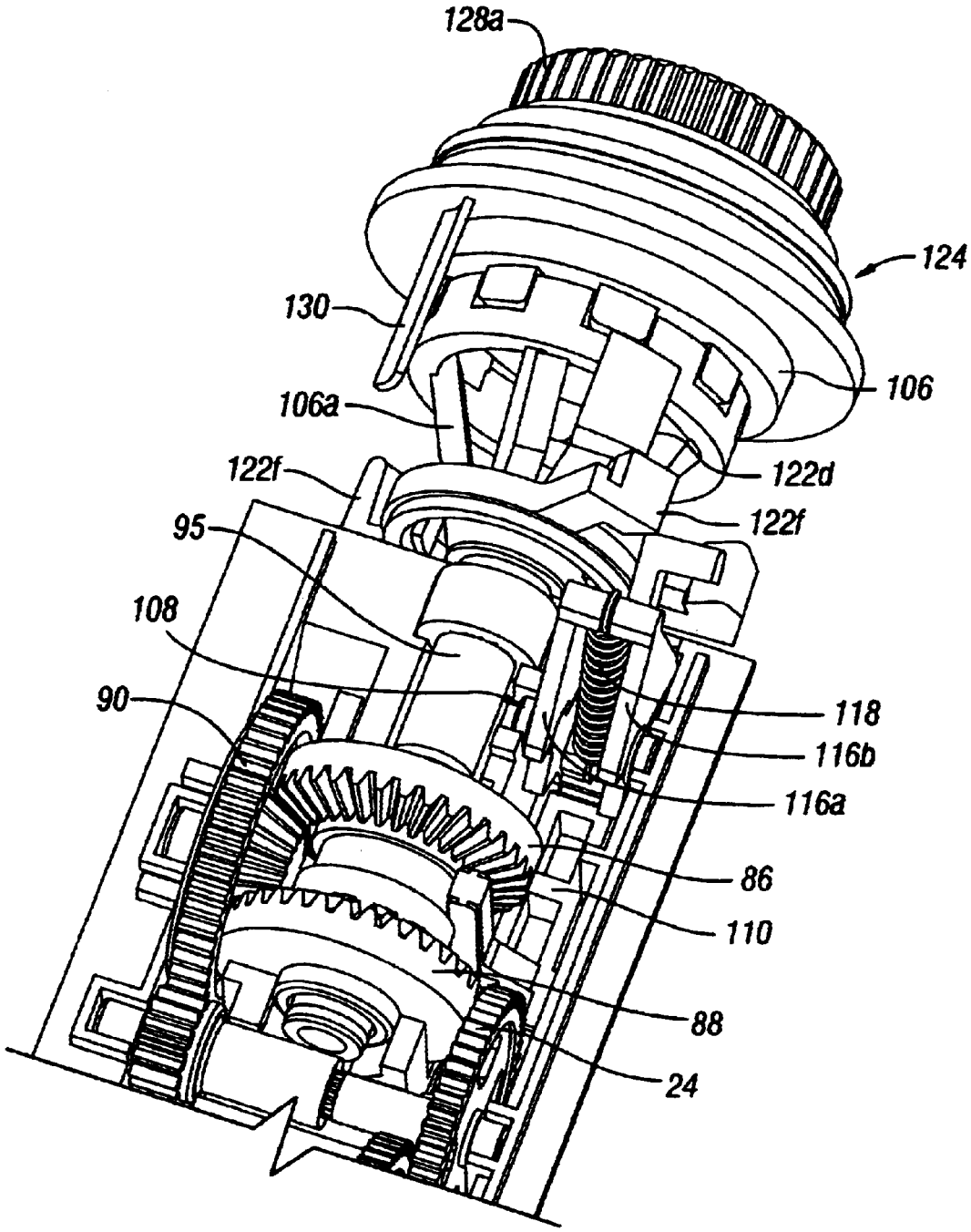
FIG. 34 is an enlarged, fragmentary perspective view of the upper portion of the drive subassembly and the turret coupling assembly similar to FIG. 34 but taken from a slightly different angle.

Details of the reversing mechanism 26 (FIG. 9) will now be discussed. It includes spaced apart upper and lower parallel bevel gears 86 and 88 (FIGS. 24, 29, 33, 34, and 40–49) that are simultaneously driven in opposite directions by a central bevel pinion gear 90 (FIGS. 40, 42–44). The bevel pinion gear 90 is indirectly driven by the turbine 20 through the gear train reduction 24 that includes spur gear 92. A sliding cylindrical clutch 94 (FIGS. 23, 24, 34, 40, 41 and 43) reciprocates up and down around a central vertical drive shaft 95 (FIGS. 24, 33 and 34). The clutch 94 has radially extending teeth 96 (FIG. 23) and 98 (FIG. 40) formed on the upper and lower sides thereof. The teeth 96 and 98 selectively engage with radially extending teeth 100 and 102 (FIG. 43), respectively, formed on the lower and upper sides of the bevel gears 86 and 88. This provides a positive driving engagement between the clutch 94 and either of the bevel gears 86 and 88.

Figure 13:
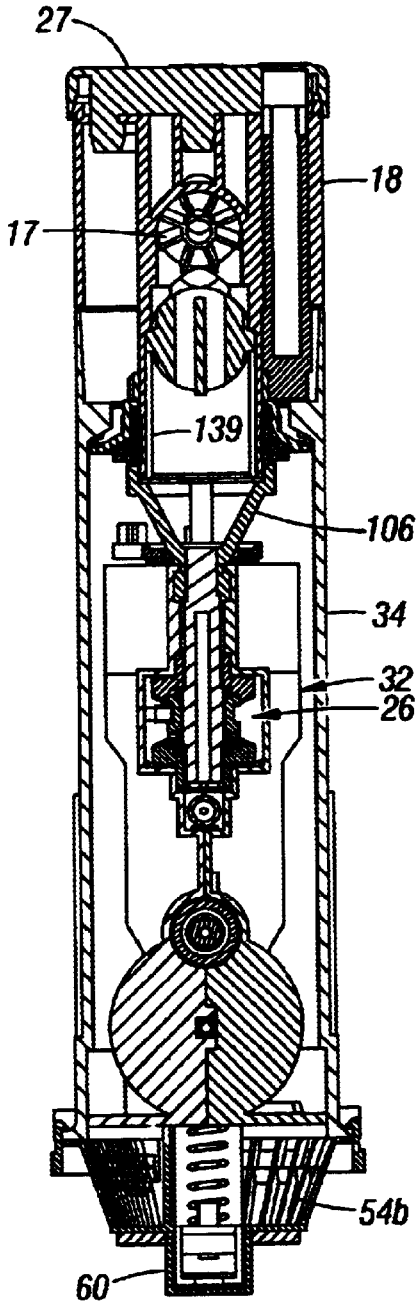
FIG. 13 is a vertical sectional view of the riser taken along line 13—13 of FIG. 12A.
Figure 14:
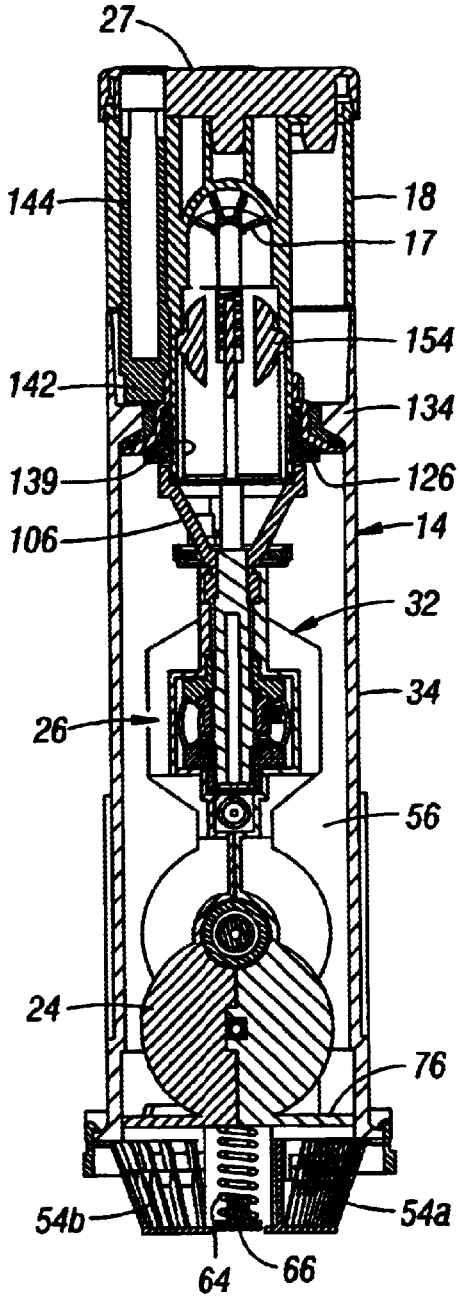
FIG. 14 is a vertical sectional view of the riser taken along line 14—14 of FIG. 12A.
Figure 21:
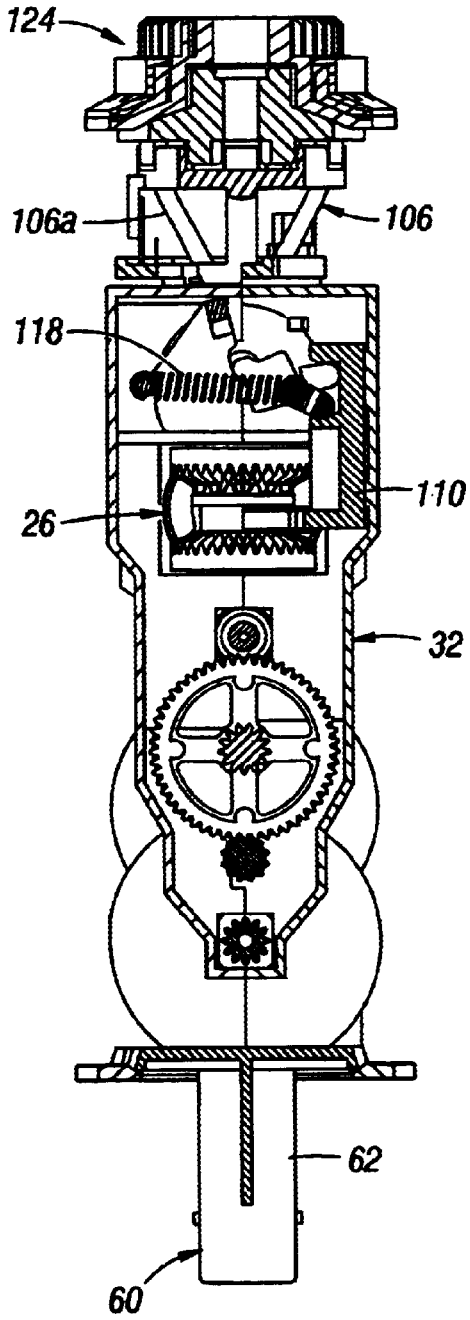
FIG. 21 is a vertical sectional view of the drive subassembly, shift disk and turret coupling assembly taken along line 21—21 of FIG. 20.

The clutch 94 is moved up and down by a vertically reciprocable horizontally extending yoke 104 (FIGS. 9 and 23) that partially encircles a smooth central cylindrical portion of the clutch 94. The yoke 104 engages upper and lower shoulders 94*a* and 94*b* (FIG. 9) of the cylindrical clutch 94 to drive the same up and down. This selectively positively engages the upper teeth 96 or the lower teeth 98 of the clutch 94 either with the teeth 100 of the upper bevel gear 86 or the teeth 102 of lower bevel gear 88. The clutch 94 is vertically reciprocable along, but splined to, the vertical drive shaft 95. By using the term "splined to" it is meant that the clutch 94 is rotatably coupled to the drive shaft 95 for rotatably driving the same, but can slide along the drive shaft 95 to alternately engage the upper and lower bevel gears 86 and 88. In other words, the shape of the hole through the clutch 94 and the shape of the portion of the drive shaft 95 that extends thereto are complementary so that the drive shaft 95 cannot rotate within the clutch 94. The upper end of the drive shaft 95 is rigidly secured to the lower end of an inverted conical drive basket 106 (FIG. 13). The drive basket 106 rotates the turret 18 containing the nozzle 17 clockwise and counter-clockwise through a turret coupling assembly 124 described hereafter in detail. The drive basket 106 includes four circumferentially spaced, upwardly diverging arms 106*a* (FIG. 21) between which the water flows in order to reach the nozzle 17. The upper and lower bevel gears 86 and 88 (FIG. 40) are both continuously and simultaneously rotated in opposite directions by the bevel pinon gear 90 as long as the turbine 20 rotates. The clutch 94 is moved up and down to selectively couple either the upper bevel gear 86 or the lower bevel gear 88 to the vertical drive shaft 95. The drive shaft 95 rotates freely in the opposite direction of the particular one of the bevel gears 86 and 88 to which it is not coupled.

Figure 43:
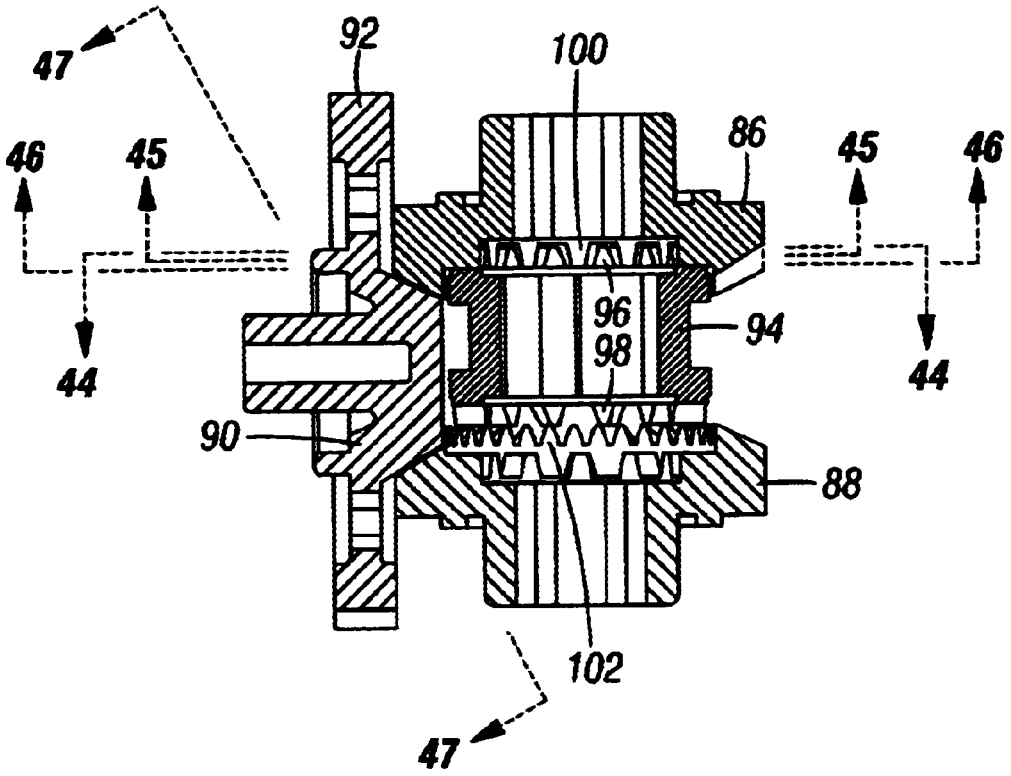
FIG. 43 is a vertical sectional view of the reversing clutch and driven bevel gears taken along line 43—43 of FIG. 41.
Figure 44:
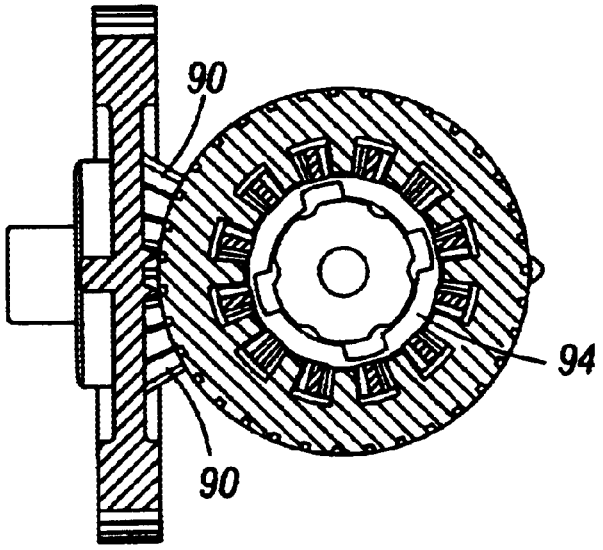
FIG. 44 is a cross-sectional view of the reversing clutch and driven bevel gears taken along line 44—44 of FIG. 43.
Figure 45:
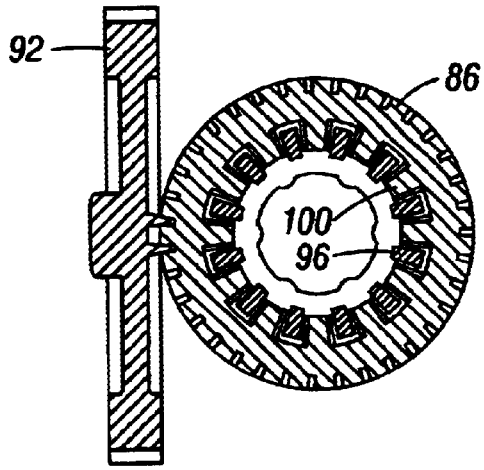
FIG. 45 is a cross-sectional view of the reversing clutch and driven bevel gears taken along line 45—45 of FIG. 43.
Figure 46:
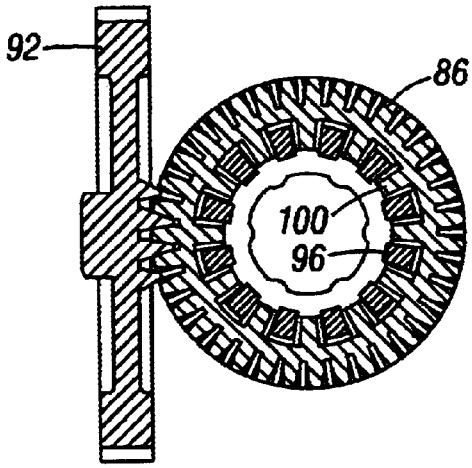
FIG. 46 is a cross-sectional view of the reversing clutch and driven bevel gears taken along line 46—46 of FIG. 43.
Figure 47:
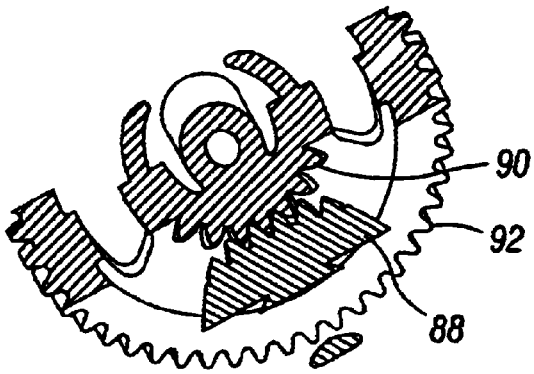
FIG. 47 is a diagonal sectional view of the reversing clutch and driven bevel gears taken along line 47—47 of FIG. 43.
Figure 48:
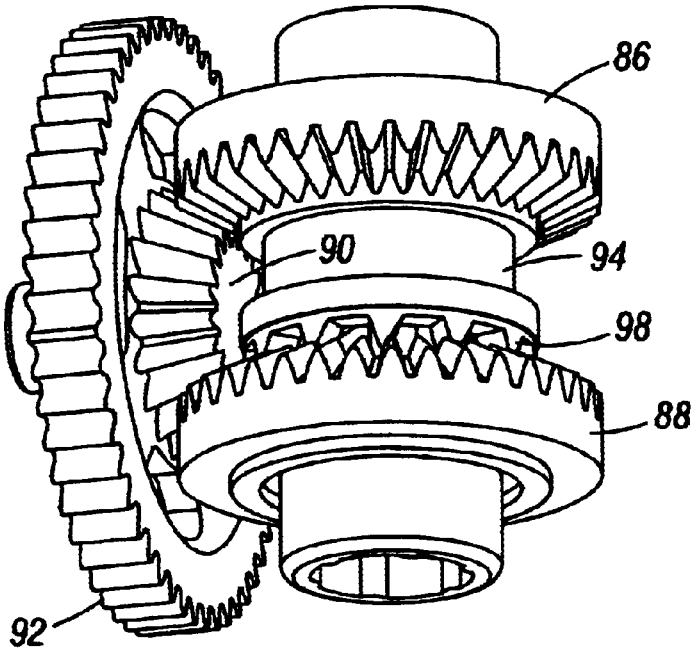
FIGS. 48 and 49 are two different perspective views taken from different angles of the reversing clutch and driven bevel gears of the reversing mechanism of the drive subassembly of FIGS. 18–34.
Figure 49:
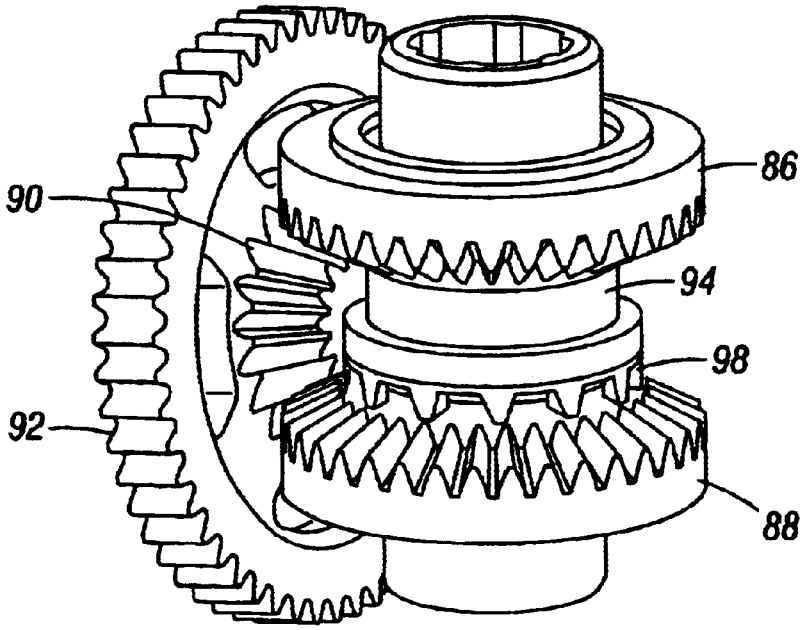
Figure 50:
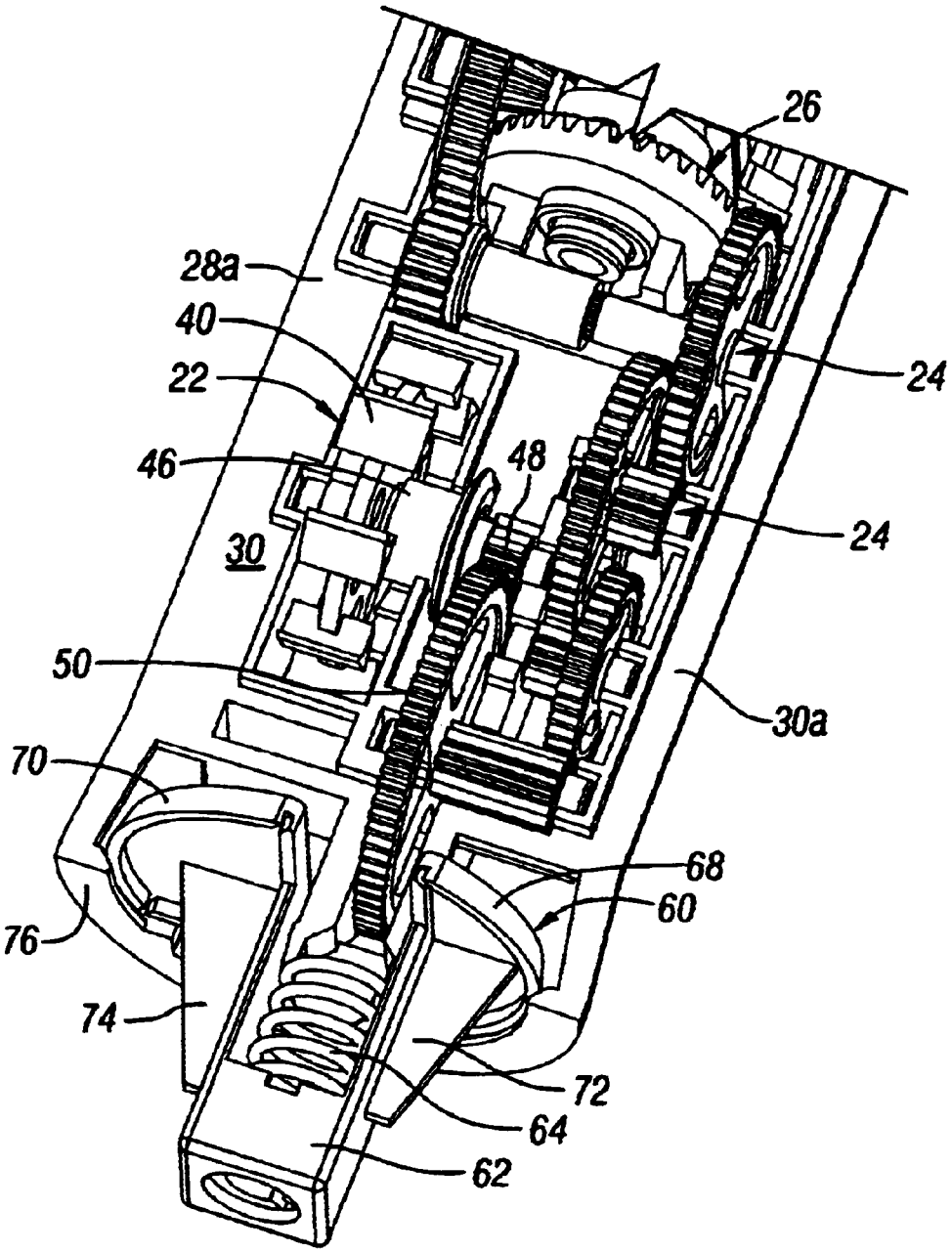
FIG. 50 is an enlarged, fragmentary perspective view of the lower portion of the drive subassembly illustrating details of its adjustable stator.

The upper teeth 96 (FIG. 23) and the lower teeth 98 (FIG. 40) of the clutch 94 as well as the downwardly facing teeth 100 and the upwardly facing teeth 102 (FIG. 43) of the upper and lower bevel gears 86 and 88, respectively, have a square shape that allow them to drive and also slip, as needed, in case of a vandal twisting the turret 18. These teeth need not have the more delicate tapered and pointed shape of conventional gear teeth. As best seen in FIG. 43 the teeth 100 and 102 of the bevel gears 86 and 88 have inclined sidewalls that join with blunt or flat horizontal faces. The upper and lower teeth 96 and 98 of the clutch have a complementary shape.

We have illustrated a preferred embodiment of our reversing mechanism 26 that employs upper and lower bevel gears 86 and 88 that are simultaneously driven in opposition rotational directions by a central bevel pinion gear 90. However, those skilled in the art will appreciate that alternatives may be substituted for the bevel gears. For example a flat spur gear rotating in a vertical plane could simultaneously engage the teeth of upper and lower flat spur gears. The three bevel gears in the reversing mechanism 26 could also be replaced with so-called "peg" wheels. As another alternative, a friction wheel with an elastomeric outer surface could simultaneously drive upper and lower discs also having friction surfaces, and these disks could be spring biased against the periphery of the friction wheel. It should therefore be understood that our reversing mechanism could employ a common rotatable driving member that is positioned between, and engages spaced apart rotatable driven members. The particular configuration of the yoke 104 is not critical and a wide variety of clutch moving members will suffice.

Figure 32:
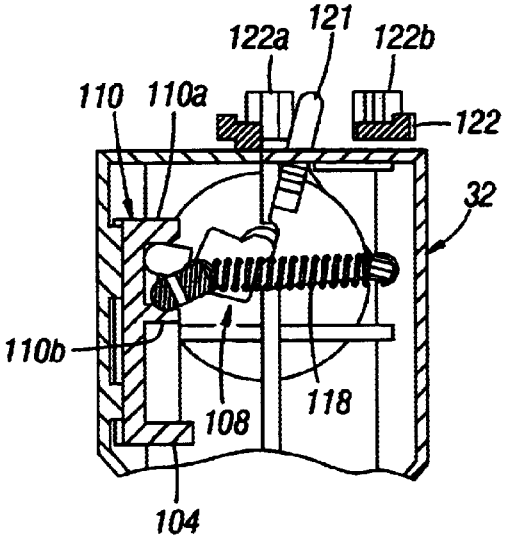
FIG. 32 is a greatly enlarged fragmentary portion of FIG. 28 illustrating further details of the toggle over-center mechanism of the drive subassembly.

Gear driven rotor type sprinklers need to have a mechanism for shifting the reversing mechanism thereof. Our sprinkler 10 incorporates a unique toggle over-center mechanism 108 (FIGS. 10, 23, and 32–39) which shifts the reversing mechanism 26. The toggle over-center mechanism has a only single spring 118 and has no "dead spot". The drive subassembly 32 includes, as part of the reversing mechanism 26, the toggle over-center mechanism 108. The toggle over-center mechanism 108 moves a link arm 110 (FIGS. 23, 32 and 34) up and down. The yoke 104 is connected to the lower end of the link arm 110. The link arm 110 slides within a conformably shaped guide portion 112 (FIG. 18) of the case member 28 which serves to retain the link arm 110 in position. The link arm 110 has a pair of upper and lower shoulders 110*a* and 110*b* (FIG. 23) that are engaged by the rounded outer end of a first lever 114 (FIG. 36) to move the link arm 110 between raised and lowered positions that selectively couple the clutch 94 to the upper bevel gear 86 and the lower bevel gear 88, respectively.

Figure 35:
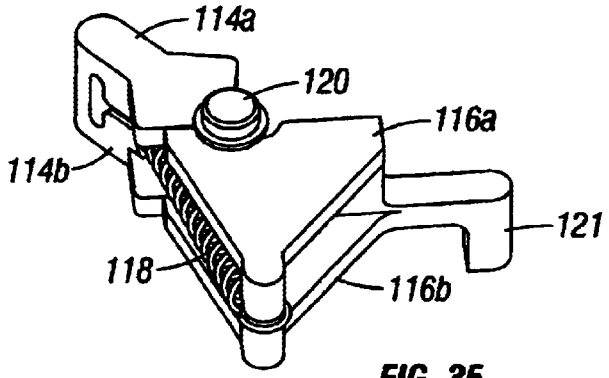
FIG. 35 is an enlarged perspective view of the twin lever assembly of the over-center mechanism of the drive subassembly.
Figure 36:
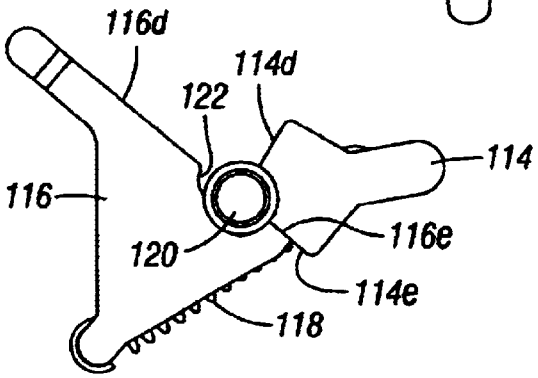
FIG. 36 is a side elevation view of the twin lever assembly.
Figure 37:
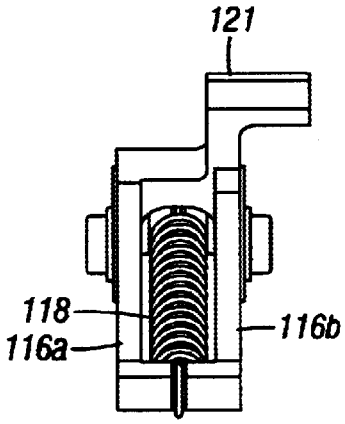
FIG. 37 is an end elevation view of the twin lever assembly taken from the left side of FIG. 36.
Figure 38:
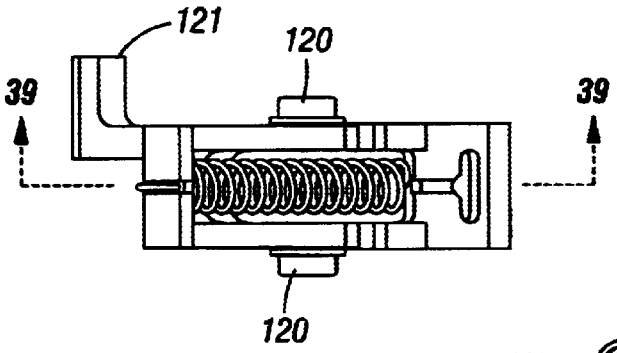
FIG. 38 is a bottom plan view of the twin lever assembly taken from the lower end of FIG. 36.
Figure 39:
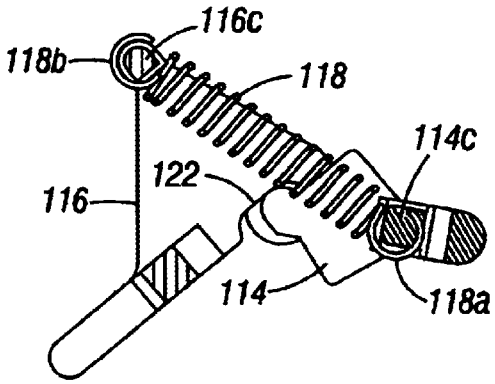
FIG. 39 is a sectional view of the twin lever assembly taken along line 39—39 of FIG. 38.
Figure 40:
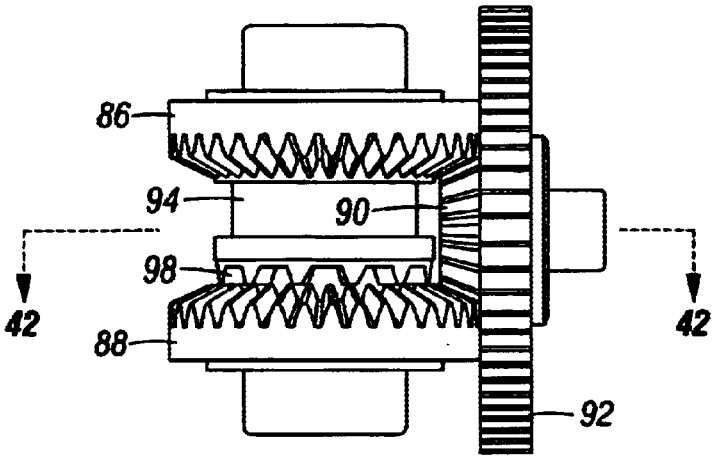
FIG. 40 is a greatly enlarged side elevation view of the reversing clutch and driven bevel gears of the reversing mechanism of the drive subassembly of FIGS. 18–34.
Figure 41:
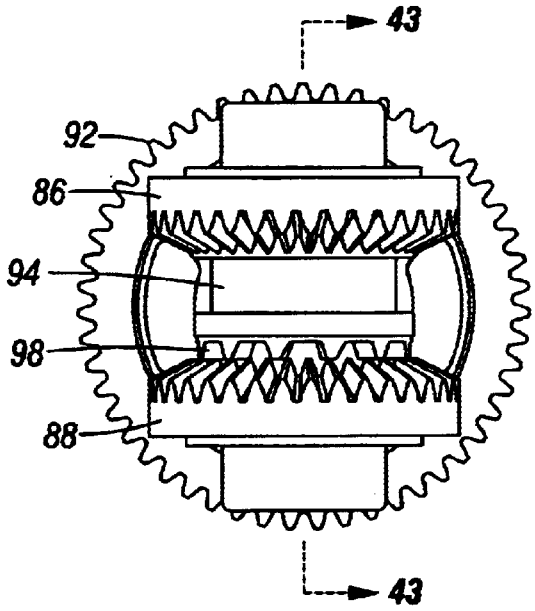
FIG. 41 is a front elevation view of the reversing clutch and driven bevel gears taken form the left side of FIG. 40.
Figure 42:
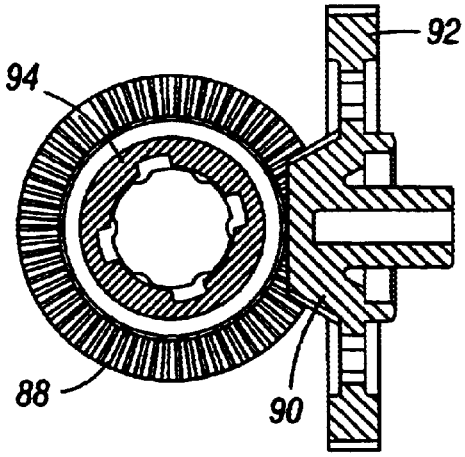
FIG. 42 is a horizontal sectional view of the reversing clutch and driven bevel gears taken along line 42—42 of FIG. 40.

The over-center mechanism 108 further includes a second lever 116 (FIG. 36). The two levers 114 and 116 are held against each other by the spring 118 (FIG. 39) which functions as an expansion spring. The first lever 114 is formed with a pair of trunnions 120 (FIGS. 35, 36 and 38) that act as a fixed center bearing point. The second lever 116 does not have a fixed center point but is instead formed with a pair of C-shaped recesses or bearing surfaces 123 (FIG. 39) that have a flat center section and curved end sections. The first lever 114 is formed of parallel, spaced apart, arrow-head shaped, flat side pieces 114*a* and 114*b* (FIG. 35). The second lever 116 is formed of parallel, spaced apart, triangular side pieces 116*a* and 116*b* (FIG. 35). The trunnions 120 (FIGS. 35, 36 and 38) are formed on one set of ends of the side pieces 114*a* and 114*b*. The bearing surfaces 123 (FIG. 39) are formed intermediate the lengths of one set of straight edges of the triangular side pieces 116*a* and 116*b*. The first and second levers 114 and 116 are mated so that each of the trunnions 120 engages a corresponding one of the bearing surfaces 123 as best seen in FIGS. 35, 36 and 39. The spring 118 (FIG. 39) holds the first and second levers 114 and 116 together.

A first C-shaped end 118*a* (FIG. 39) of the spring 118 is retained about a post 114*c* formed at one end of the first lever 114. A second C-shaped end 118*b* (FIG. 39) of the spring 118 is retained about a post 116*c* formed at one end of the first lever 116. As explained hereafter, the posts 114*c* and 116*c* form attachment points for the spring 118 which hold the first and second levers 114 and 116 in mating relation and, along with the special configuration of the levers, ensure that the levers 114 and 116 positively move back and forth between two end limit configurations without stalling therebetween. One end limit configuration of the over-center mechanism 108 is illustrated in FIG. 36 in which the flat surfaces 114*e* of the first lever 114 abut the flat surfaces 116*e* of the second lever 116. When the over-center mechanism 108 flips to its other end limit configuration, the flat surfaces 114*d* of the first lever 114 abut the flat surfaces 116*d* of the second lever 116. Between the two end limit configurations, the first lever 114 rotates slightly less than ninety degrees relative to the second lever 116.

Figure 31:
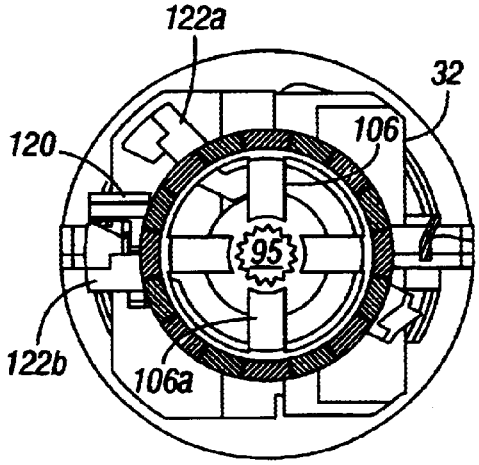
FIG. 31 is a greatly enlarged version of FIG. 26 illustrating details of the drive subassembly, shift disk and drive basket.

The second lever 116 is formed with an upstanding L-shaped actuating arm 121 (FIGS. 32 and 35–37). The actuating arm 121 extends through a slot in formed in the upper ends of the case members 28 and 30 where they mate and is engaged and moved back and forth by the spaced apart legs 122*a* and 122*b* (FIGS. 31 and 32) of a horseshoe-shaped shift disk 122 (FIGS. 33, 34, 60, 62, 65, 66, 68, 73 and 74).

The two levers 114 and 116 (FIG. 36) of the over-center mechanism 108 are held against each other by the spring 118. The trunnions 120 of the first lever 114 function as fixed center point bearings for the lever 114. The second lever 116 does not have a fixed center point but its triangular side pieces 116*a* and 116*b* are formed with the C-shaped bearing surfaces 123 (FIG. 39). The trunnions 120 are received in corresponding bearing surfaces 123 and can slide back and forth along the straight segments of the surfaces 123 between the curved end segments thereof. As the levers 114 and 116 rotate relative to each other against the contraction force of the spring 118, a line of force will eventually cross a center point and levers 114 and 116 will continue to rotate in the same direction but now in response to, and with the aid of, the contraction force of the spring 118. Thus the over-center mechanism 108 can operate with a single spring 118 and produce a similar effect to prior art over center shifting mechanisms requiring both a clutch spring force and a separate reversing force.

Flat angled surfaces 14*d* and 14*e* (FIG. 36) on each of the arrow-shaped flat side pieces 114*a* and 114*b* of the first lever 114 respectively engage the flat surfaces 116*d* and 116*e* of the triangular side pieces 116*a* and 116*b* of the second lever 116 to limit the angular rotation between the first lever 114 and the second lever 116. The flat surfaces 116*d* and 116*e* extend on either side of the C-shaped bearing surfaces 123 (FIG. 39). This architecture of the toggle over-center mechanism 108 ensures that it will not have a locked position or dead spot that would cause the turret 18 and nozzle 17 to stall.

Figure 67:
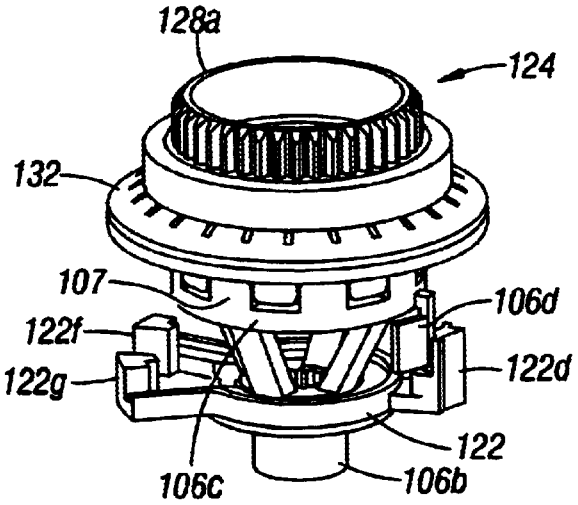
FIG. 67 is a perspective view of one side of the turret coupling assembly and shift disk.
Figure 68:
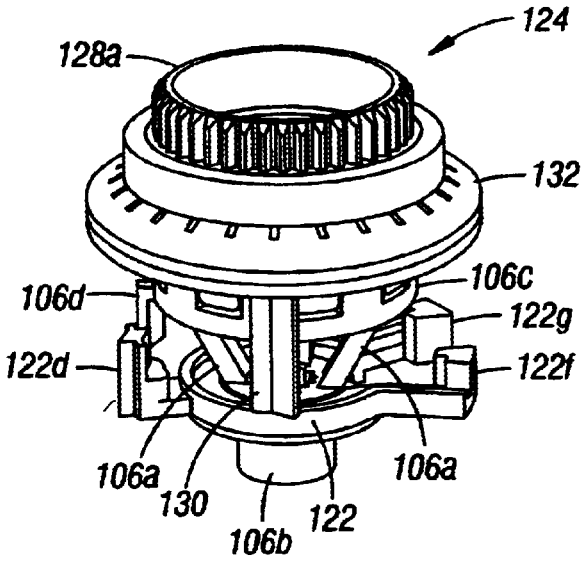
FIG. 68 is a perspective view of the other side of the turret coupling assembly and shift disk.
Figure 73:
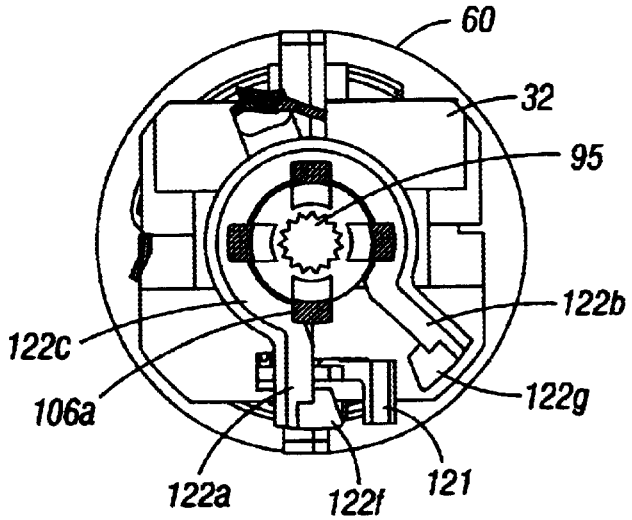
FIG. 73 is a horizontal sectional view taken along lines 73—73 of FIG. 69 illustrating further details of the drive subassembly, turret coupling assembly, conical drive basket, over-center mechanism and shift disk.
Figure 74:
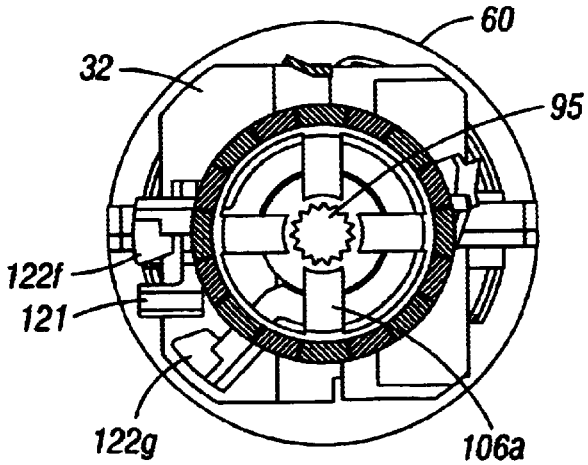
FIG. 74 is a horizontal sectional view taken along lines 74—74 of FIG. 70 illustrating further details of the turret coupling assembly, conical drive basket, drive subassembly case members, over-center mechanism and shift disk.

The shift disk 122 (FIG. 67) has a main ring-shaped annular portion 122*c* (FIG. 65) with an actuator post 122*d* that extends vertically from a horizontal tab 122*e* that extends horizontally from the annular portion 122*c* opposite the two legs 122*a* and 122*b*. The annular portion 122*c* of the shift disk 122 surrounds the narrow lower end of the conical drive basket 106. Another pair of vertical actuator posts 122*f* and 122*g* (FIGS. 65 and 67) extend vertically from corresponding legs 122*a* and 122*b* of the shift disk 122. As will be explained hereafter in detail, the actuator posts 122*d*, 122*f* and 122*g* cooperate with tabs 106*d* and 130 to cause the shift disk 122 to actuate the over-center mechanism 108 of the reversing mechanism 26 to shift and cause the turret 18 and the nozzle 17 therein to rotate back and forth between predetermined limits. In this manner, the nozzle 17 ejects a stream of water over a prescribed arc, which is adjustable in size. The first lever 114 and the second lever 116 are pivotable relative to each other and relative to a common horizontal pivot axis in order to shift the reversing mechanism 26. The outermost end of the outer one of the trunnions 120 is captured by inwardly extending projections formed in the case members 28 and 30 to establish this horizontal pivot axis. The yoke 104 and the link arm 110 are vertically reciprocable to move the clutch 94 between first (raised) and second (lowered) positions for reversing a direction of rotation of the nozzle 17. The link arm 110 connects an outer end of the clutch 94 to one end of the first lever 114 so that pivoting motion of the first lever 114 will move the link arm 110 to move the clutch 94 between the first and second positions.

Figure 23:
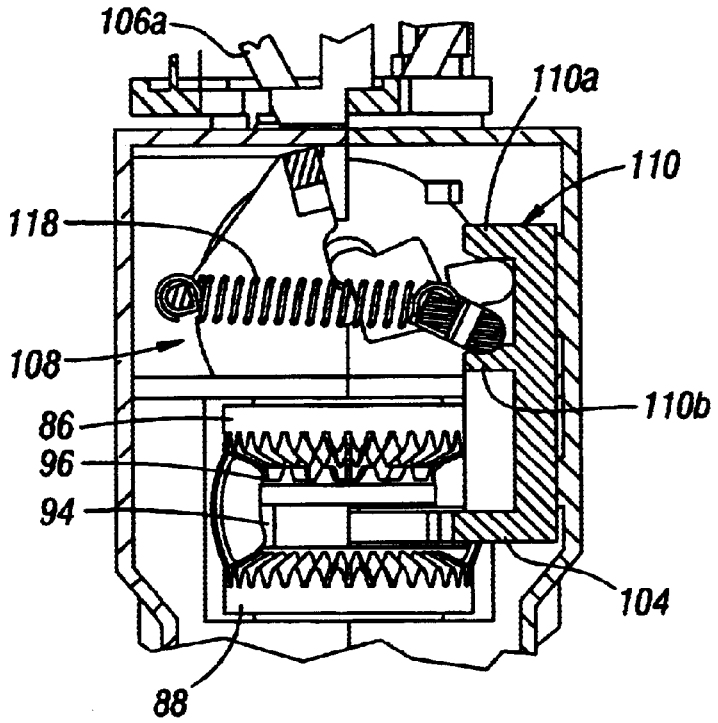
FIG. 23 is a greatly enlarged fragmentary portion of FIG. 21 showing further details of the reversing clutch, driven bevel gears and toggle over-center mechanism of the drive subassembly.
Figure 24:
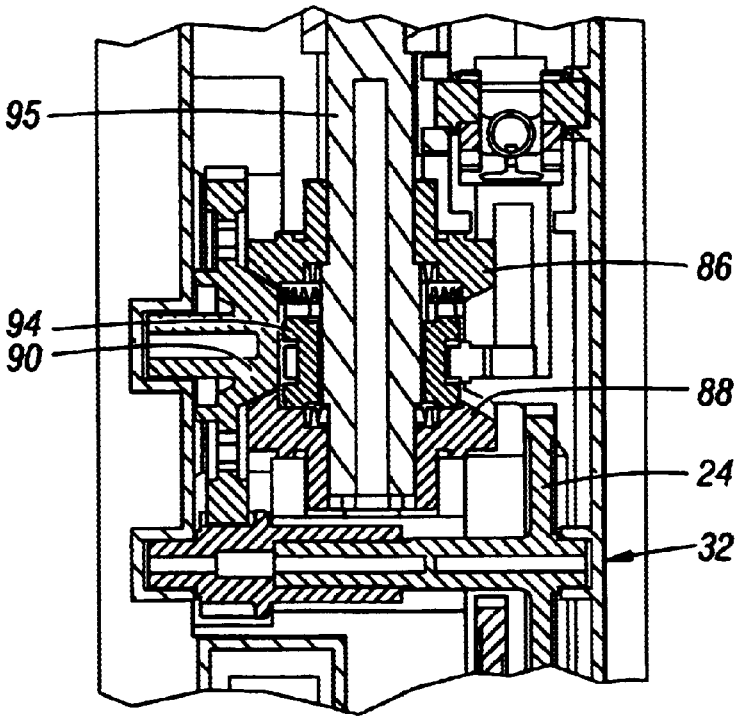
FIG. 24 is a greatly enlarged fragmentary portion of FIG. 20 showing further details of the reversing clutch, driven bevel gears and toggle over-center mechanism of the drive subassembly.
Figure 25:
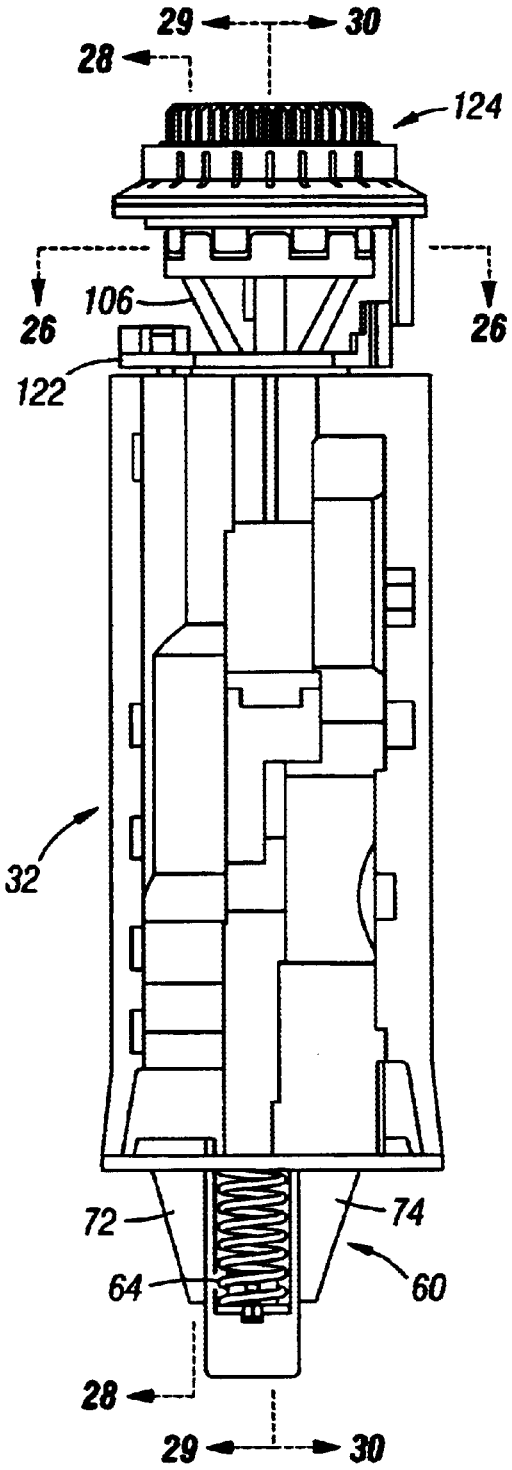
FIG. 25 is a side elevation view of the drive subassembly, shift disk and turret coupling assembly of the sprinkler of FIG. 1 taken from the left side of FIG. 18.
Figure 26:
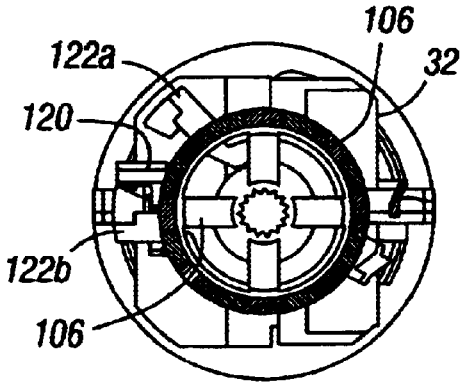
FIG. 26 is a horizontal sectional view taken along line 26—26 of FIG. 25.
Figure 27:
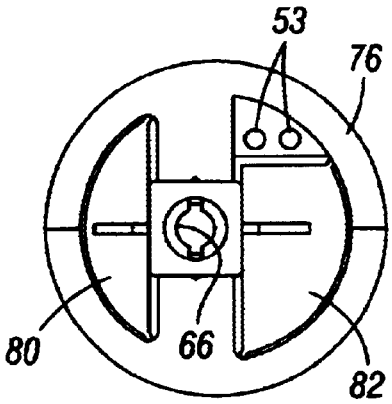
FIG. 27 is a bottom plan view of the drive subassembly taken from the lower end of FIG. 25.
Figure 28:
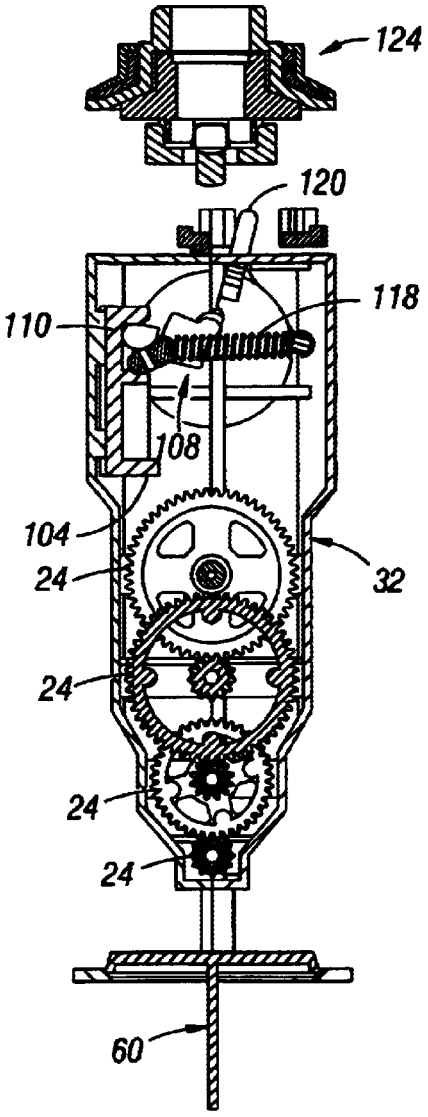
FIG. 28 is a vertical sectional view of the drive subassembly, shift disk and turret coupling assembly taken along line 28—28 of FIG. 25.
Figure 29:
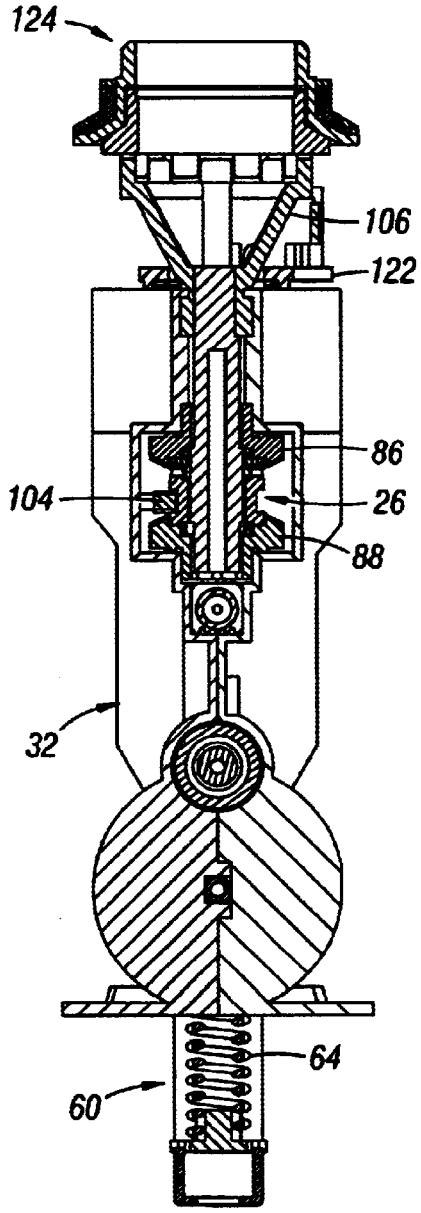
FIG. 29 is a vertical sectional view of the drive subassembly, shift disk and turret coupling assembly taken along line 29—29 of FIG. 25.
Figure 30:
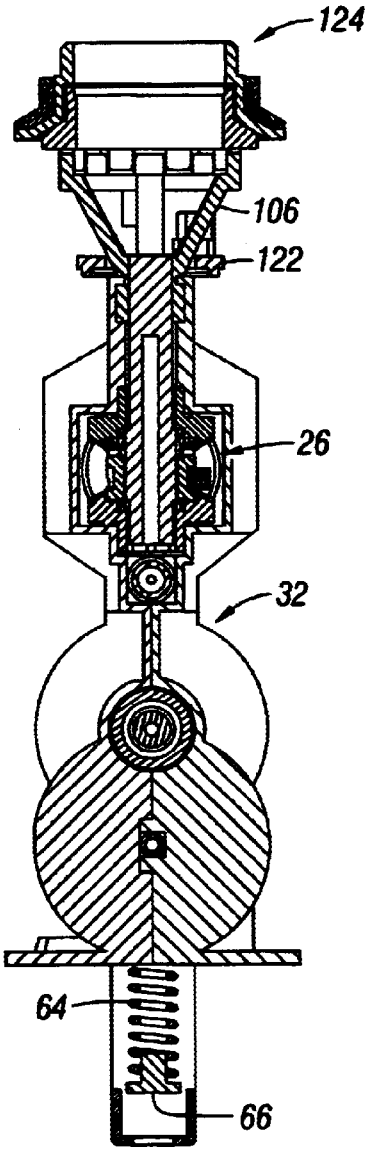
FIG. 30 is a vertical sectional view of the drive subassembly, shift disk and turret coupling assembly taken along line 30—30 of FIG. 25.
Figure 79:
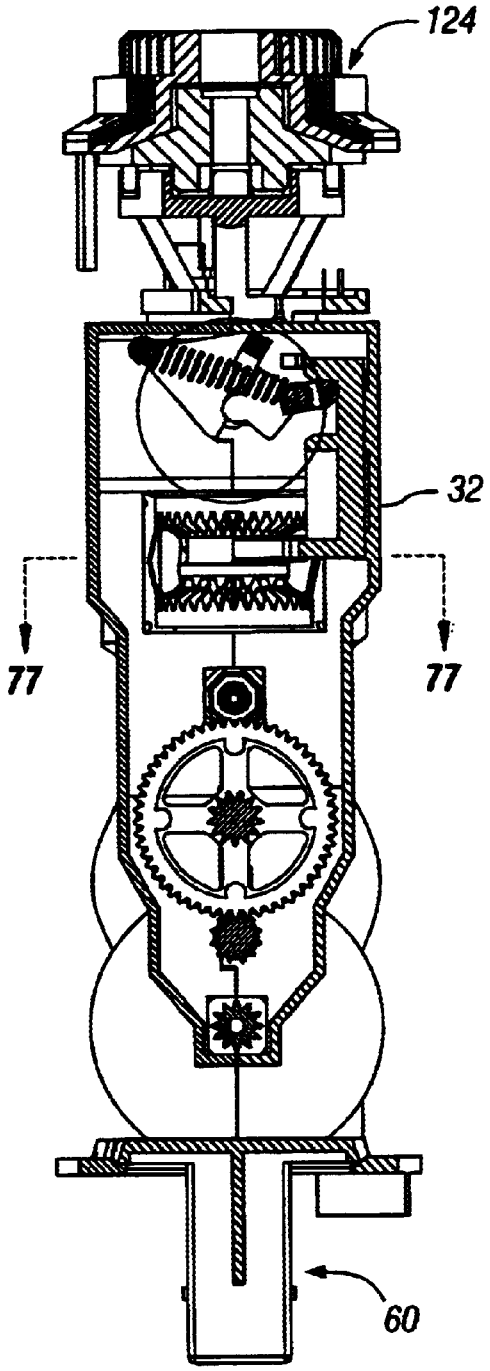
FIG. 79 is a vertical sectional view taken along line 79—79 of FIG. 78 illustrating further details of the drive subassembly, bevel gear reversing mechanism, over-center mechanism, shift disk and turret coupling assembly.

FIGS. 23 and 79 illustrate the lowered and raised positions, respectively, of the clutch 94 and link arm 110. The two different rotational positions of the first lever 114 are visible in these two views. As the shift disk 122 moves the second lever 116 back and forth, the first lever 114 is moved back and forth. This causes the link arm 110 and the clutch 94 to be vertically reciprocated, which shifts the direction of rotation of the nozzle 17. The first and second levers 114 and 116 rotate in opposite directions relative to each other as the shift disk 122 engages and moves the upstanding L-shaped actuating arm 121 (FIGS. 32 and 35–37) of the second lever 116. The levers 114 and 116 rotate relative to each other against the contraction forces of the spring 118. The geometry of the levers 114 and 116 prevents them from having any dead spot that would cause the reversing mechanism 26 to stall. The force of the spring 118 helps to snap the link arm 110 and the clutch 94 back and forth. Thus the over-center mechanism 108 provides the force necessary to move the clutch 94 and link arm 110 in linear fashion. The levers 114 and 116 are shaped and configured and the spring attachment posts 114*c* and 116*c* are located so that the first and second levers are biased toward one or the other of the end limit configurations by the contraction force of the spring 118.

A plurality of engaging portions of the first and second levers 114 and 116 that engage each other, and a pair of attachment points for the spring 118 are selected to ensure that the levers 114 and 1116 will positively rotate between two predetermined opposite end limit configurations with minimal chance of stalling at a third configuration intermediate the two end configurations. In the illustrated embodiment, the engaging portions of the first lever 114 include the trunnions 120 and the fiat angled surfaces 114*d* and 114*e*. The engaging portions of the second lever 116 include the bearing surfaces 123 and the flat surfaces 116*d* and 116*e*. The flat angled surfaces 114*d* and 114*e* of the first lever 114 engage a plurality the flat surfaces 116*d* and 116*e* of the second arm 116 to define the two end limit configurations of the levers 114 and 116.

Figure 69:
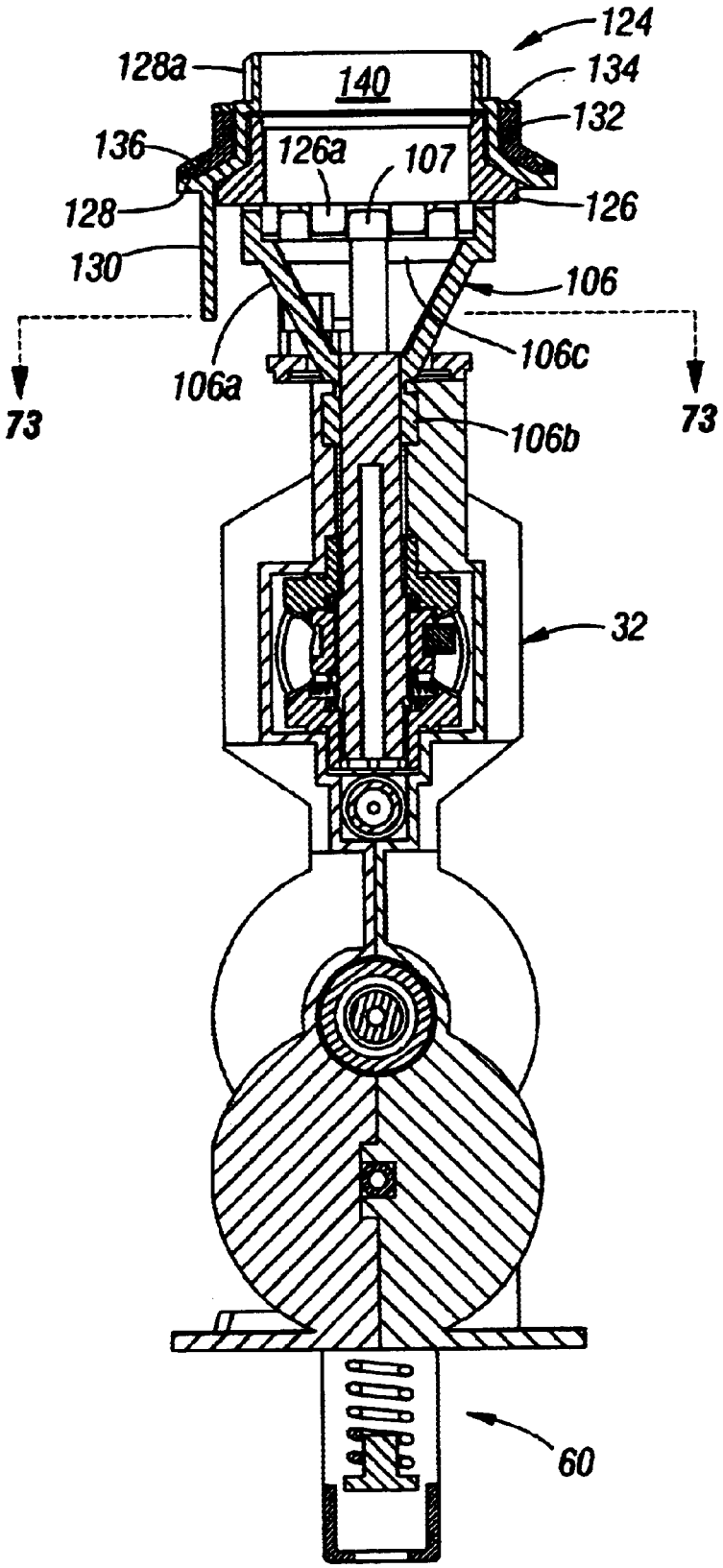
FIG. 69 is a vertical sectional view of the drive subassembly, turret coupling assembly and shift disk of the sprinkler of FIGS. 1, 2 and 4 taken along line 69—69 of FIG. 70.
Figure 70:
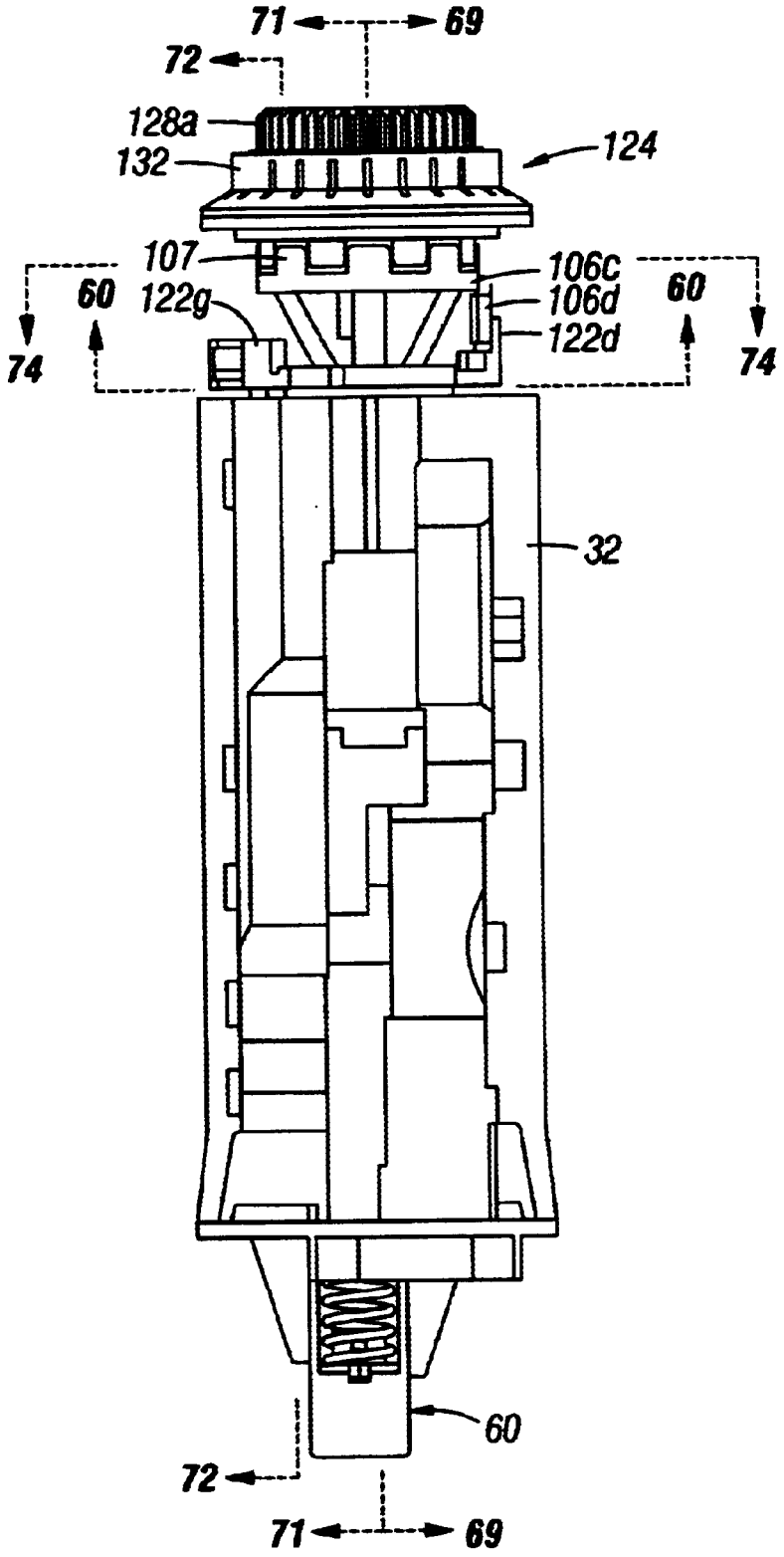
FIG. 70 is a side elevation view of the drive subassembly, turret coupling assembly and shift disk of the sprinkler of FIGS. 1, 2 and 4.
Figure 71:
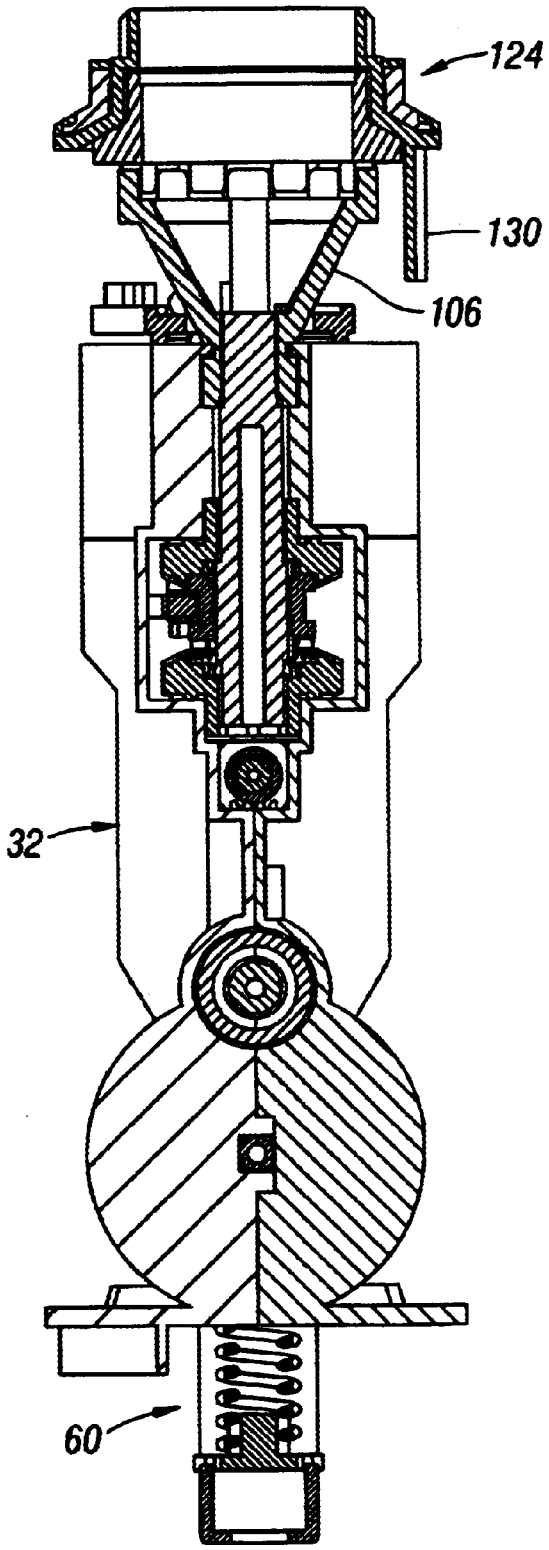
FIG. 71 is a vertical sectional view of the drive subassembly, turret coupling assembly and shift disk of the sprinkler of FIGS. 1, 2 and 4 taken along line 71—71 of FIG. 70.
Figure 72:
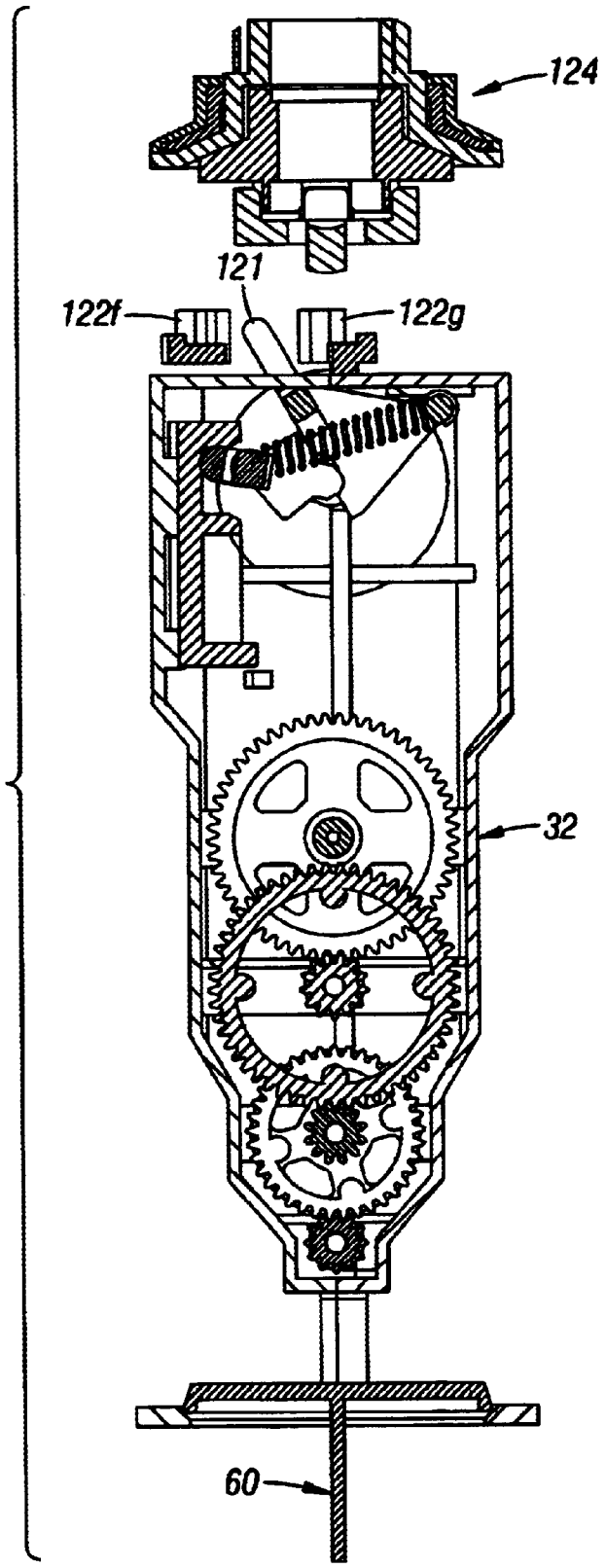
FIG. 72 is a vertical sectional view of the drive subassembly, turret coupling assembly and shift disk of the sprinkler of FIGS. 1, 2 and 4 taken along line 72—72 of FIG. 70.
Figure 75:
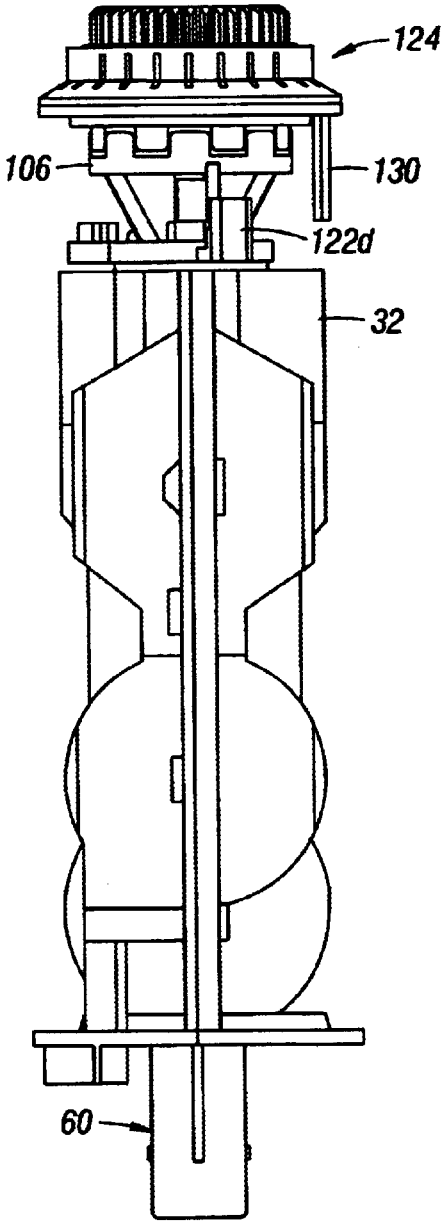
FIG. 75 is a side elevation view of the drive subassembly, turret coupling assembly and shift disk of the sprinkler of FIGS. 1, 2 and 4 rotated ninety degrees about a vertical axis from the side elevation view illustrated in FIG. 70.
Figure 76:
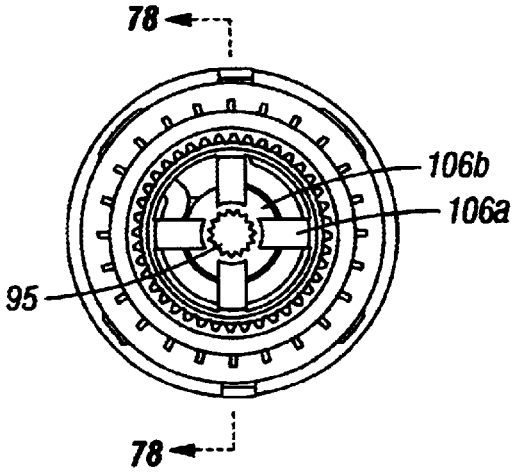
FIG. 76 is a top plan elevation view taken from the top of FIG. 72 illustrating further details of the turret coupling assembly.
Figure 77:
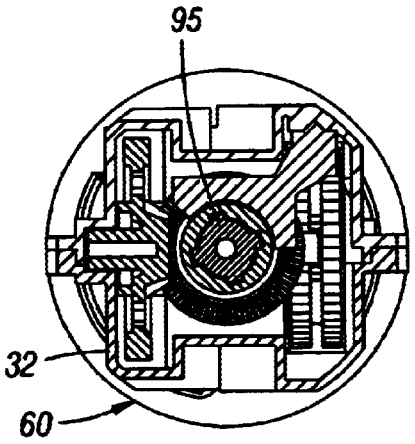
FIG. 77 is a horizontal sectional view taken along line 77—77 of FIG. 79 illustrating further details of the bevel gear reversing mechanism.
Figure 78:
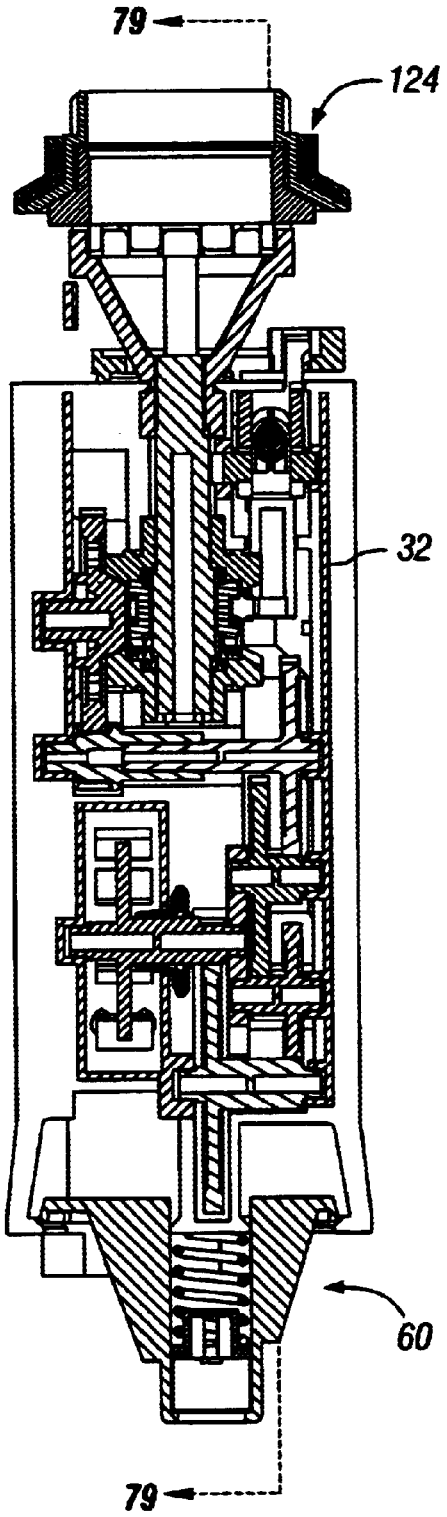
FIG. 78 is a vertical sectional view taken along line 78—78 of FIG. 76.

FIGS. 58–79 illustrate details of the turret coupling assembly 124 that connects the drive shaft 95 of the reversing mechanism 26 to the turret 18 containing the nozzle 17. The turret coupling assembly 124 includes the inverted conical drive basket 106. The shift disc 122 works in conjunction with the turret coupling assembly 124 and the over-center mechanism 108 to cause the turret 18 and the nozzle 17 contained therein to rotate back and forth through an adjustable arc. Referring to FIG. 69 the lower cylindrical end 106*b* of the inverted conical drive basket 106 is splined to the upper end of the drive shaft 95. The upper ring-shaped end 106*c* (FIG. 70) of the drive basket 106 is formed with a plurality of equally circumferentially spaced vertical drive lugs 107 that fit between mating vertical drive lugs 126*a* formed on the lower end of a cylindrical housing coupling 126 (FIG. 69). A cylindrical adjusting sleeve 128 sits on top of the housing coupling 126. The adjusting sleeve 128 has a bull gear 128*a* (FIGS. 69 and 70) formed at the upper end thereof. A shift tab 130 (FIGS. 59, 69, 71 and 75) extends vertically downwardly from the adjusting sleeve 128 and engages the vertical actuator post 122*d* (FIG. 65) of the shift disk 122 to rotate the same, flipping over the actuating arm 121 (FIG. 32) of the over-center mechanism 108. A thrust washer 132 (FIG. 69) sits on top of the adjusting sleeve 128 and its ribbed outer surface engages a shoulder 134 (FIG. 4) of the inner cylindrical housing 34 of the riser 14. Upper and lower elastomeric thrust washer seals 136 and 138 (FIG. 36) are co-molded to the rigid plastic thrust washer 132.

The nozzle 17 (FIG. 4) inside the turret 18 (FIG. 13) is part of a unitary plastic molded structure that includes a vertical cylindrical hollow shaft 139 (FIG. 4) that extends through a cylindrical opening 140 (FIG. 69) through the turret coupling assembly 124 and seats inside the upper ring-shaped end 106*c* of the inverted conical drive basket 106. Water that has mostly flowed around the drive subassembly 32, and the remainder that has driven the turbine 20, all eventually flows through the upwardly angled arms 106*a* of the inverted conical drive basket, through the hollow shaft 139 and out the nozzle 17.

The inverted conical drive basket 106 has a vertical shift tab 106*d* (FIG. 68) which extends downwardly from the upper ring-shaped end 106*c*. The rotation of the turbine 20 is carried through the gear train reduction 24 and reversing mechanism 26 to turn the drive shaft 95. The drive shaft 95 turns the turret 18 via the drive basket 106 of the turret coupling assembly 124. As the turret 18 rotates the actuator post 122*d* (FIG. 67) of the shift disk 122 alternately engages the shift tab 130 (FIG. 69) of the adjusting sleeve 128 and the shift tab 106*d* of the conical drive basket 106. This rotates the shift disk 122 so that its actuator posts 122*f* and 122*g* (FIG. 65) move the L-shaped actuating arm 121 of the over-center mechanism 108 back and forth, driving the clutch 94 (FIGS. 9 and 43) up and down and reversing the rotation of the turret 18 (FIG. 13).

Figure 8:
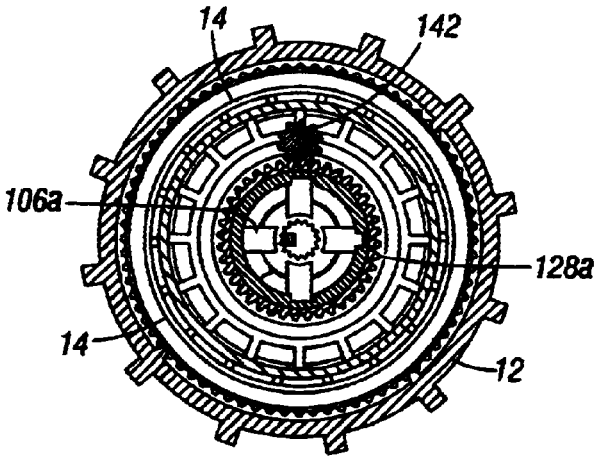
FIG. 8 is a horizontal sectional view of the sprinkler taken along line 8—8 of FIG. 1.
Figure 88:
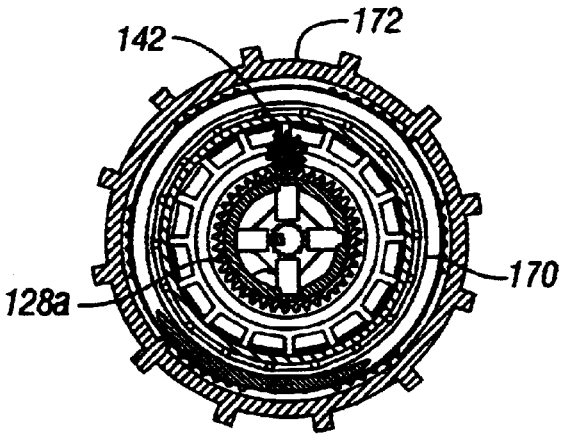
FIG. 88 is a horizontal sectional view of the alternate embodiment taken along line 88—88 of FIG. 90.
Figure 89:
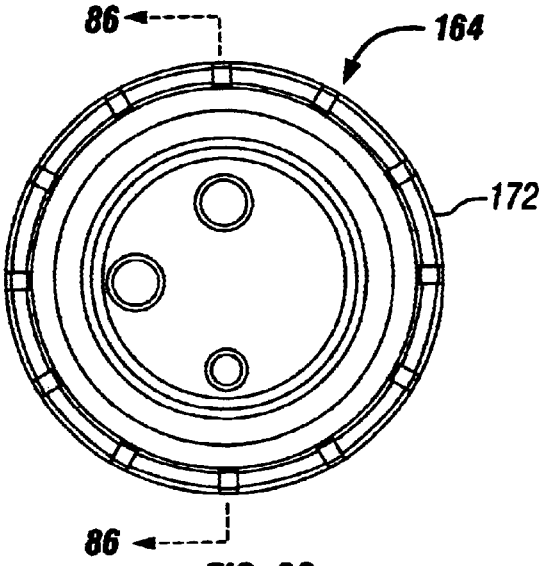
FIG. 89 is a top plan view of the alternate embodiment.
Figure 90:
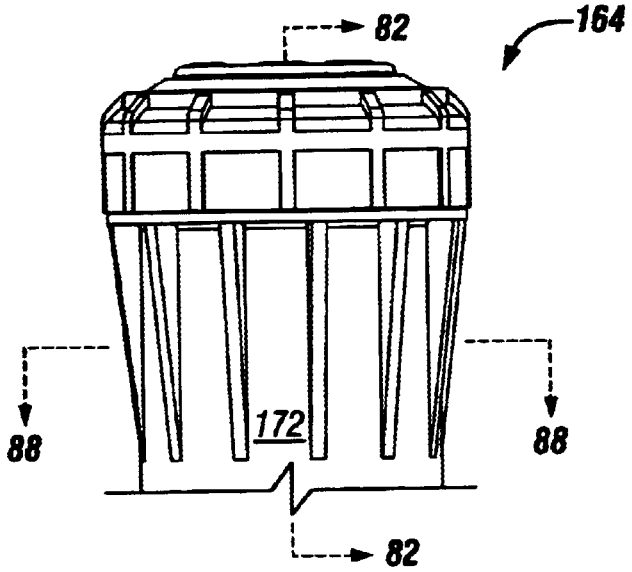
FIG. 90 is a side elevation view of the upper end of the alternate embodiment.
Figure 91:
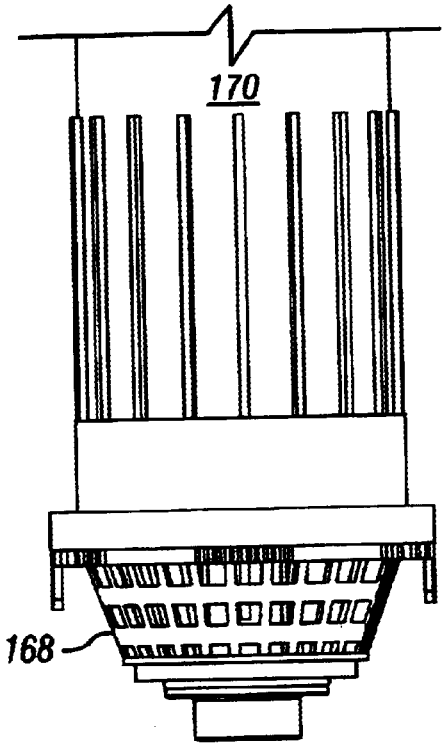
FIG. 91 is a fragmentary side elevation view of the lower end of the riser of the alternate embodiment of the sprinkler showing its ribbed inner cylindrical housing.

The shift tab 106*d* is the "fixed" arc limit on one end of the adjustable arc whereas the shift tab 130 is the adjustable arc limit. The shift tab 130 extends downwardly from the adjusting sleeve 128 (FIG. 69). The bull gear 128*a* (FIG. 70) at the upper end of the adjusting sleeve 128 may be engaged by a pinion gear 142 (FIGS. 2, 8 and 88) at the lower end of a hollow cylindrical arc adjustment shaft 144. The adjustment shaft 144 is vertically reciprocable within a cylindrical sleeve 146 formed in the turret 18. A split drive collect 148 is connected to the upper end of the adjustment shaft 144 and may be engaged by the lower end of the conventional HUNTER® hand tool (not illustrated) to move the arc adjustment shaft 144 downwardly to engage the pinion gear 142 with the bull gear 128*a* (FIGS. 8 and 88). Once the pinion gear 142 and the bull gear 128*a* mesh, the tool is rotated to move the annular position of the shift tab 130 and thereby establish the arc size. The riser 14 of the sprinkler 10 has a ratchet mechanism hereafter described that allows it to be rotated relative to the outer housing 12 in order to ensure that the selected arc coverage is oriented with respect to the turf other landscaping to be watered. Once the position of the shift tab 130 has been set, the arc adjustment shaft 144 is lifted or raised to disengage the pinion gear 142 with the bull gear 128*a*. The collet 148 is accessible from the top end of the sprinkler through the cross-hair slits 27*b* (FIG. 3) of the elastomeric cap member 27. The arc adjustment shaft 144 may be biased by a spring (not illustrated) to its raised position. However, more preferably, the arc adjustment shaft 144 and the collet 148 can be locked in their raised and lowered positions without the need for a spring. See U.S. Pat. No. 6,042,021 of Mike Clark granted Mar. 28, 2000, entitled "Arc Adjustment Tool Locking Mechanism for Pop-Up Rotary Sprinkler", the entire disclosure of which is hereby incorporated by reference.

Figure 64:
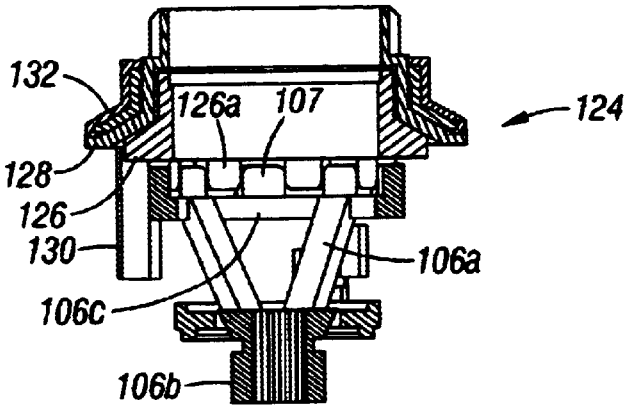
FIG. 64 is a vertical sectional view of the turret coupling assembly and shift disk taken along line 64—64 of FIG. 58.
Figure 65:
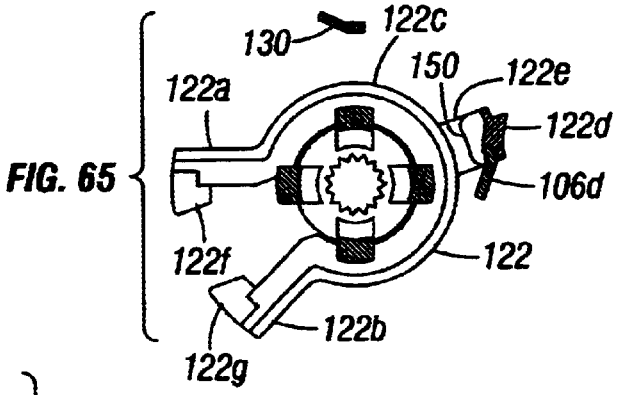
FIG. 65 is a horizontal sectional view taken along line 65—65 of FIG. 59 illustrating details of the conical drive basket of the turret coupling assembly and the shift disk.
Figure 66:
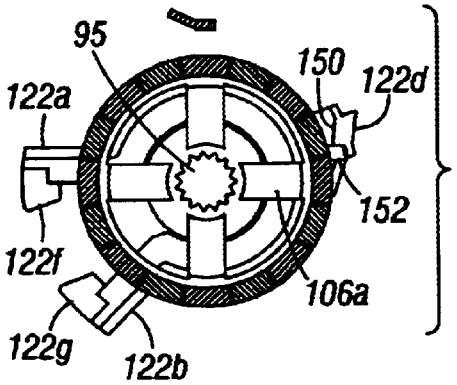
FIG. 66 is a horizontal sectional view taken along line 66—66 of FIG. 59 illustrating further details of the turret coupling assembly and shift disk.

Our sprinkler has a vandal-resistant arc return feature. If a vandal rotates the turret 18 outside of its arc limits, the turret 18 will return to oscillation within its preset-arc limits, so that pavement, windows, people, etc. will not be watered beyond the initial single pass of the nozzle 17. Referring to FIG. 64, the shift tab 106*d* and the shift tab 130 each have a horizontal cross-section that is slightly bent or "dog-legged". The actuator post 122*d* has a tapered inner wall 150 and the shift tabs 106*d* and 130 are sufficiently flexible in the radial direction so that either shift tab 106*d* or 130 can momentarily bend or defect radially a sufficient amount to ride over and past the wall 150 when the turret 18 is rotated past its arc limits. Thereafter, once the vadal has let go of the turret 18, the turbine 20 will drive either shift tab 106*d* or 130 until it engages an abutment wall 152 (FIG. 66) on the actuator post 122*d* which is configured so that the shift tab 106*d* or 130*d* cannot radially deflect and move past the same. This causes the shift disk 122 to actuate the over-center mechanism 108, reversing the rotating of the turret 18. The turret thereafter continues to oscillate between its originally set arc limits.

In some instances it would be desirable to shut off the flow of water through the sprinkler 10 when the irrigation controller is still causing pressurized water to be delivered to the sprinkler 10 so that the riser 14 is in its extended position. This will permit, for example, the nozzle 14 to be replaced with a nozzle providing a different precipitation rate. See for example U.S. Pat. No. 5,699,962 of Loren Scott et al. granted Dec. 23, 1997 entitled "Automatic Engagement Nozzle", the entire disclosure of which is hereby incorporated by reference. Therefore, the sprinkler 10 is constructed with a pivoting flow stop valve 154 (FIG. 2). The flow stop valve 154 has a rounded perimeter and is curved in cross-section. The flow stop valve 154 pivots within the hollow shaft 139 (FIG. 2) about an axis that traverses its diameter. A spur gear segment 156 (FIG. 4) extends from one side of the valve 154. A worm gear 158 on the lower end of a valve adjustment shaft 160 engages the spur gear segment 156. A slotted collet 162 connected to the upper end of the valve adjustment shaft 160 can be engaged by the lower end of the conventional HUNTER® hand tool inserted through the cross-hair slits 27*c* in the elastomeric cap member 27. The tool can be rotated to turn the valve adjustment shaft 160 to pivot the valve 154 between opened and closed positions. Further details of the flow stop valve mechanism may be found in allowed U.S. patent application Ser. No. 09/539,645 of Mike Clark et al. filed Mar. 30, 2000 and entitled "Irrigation Sprinkler with Pivoting Throttling Valve", the entire disclosure of which is hereby incorporated by reference.

Figure 1:
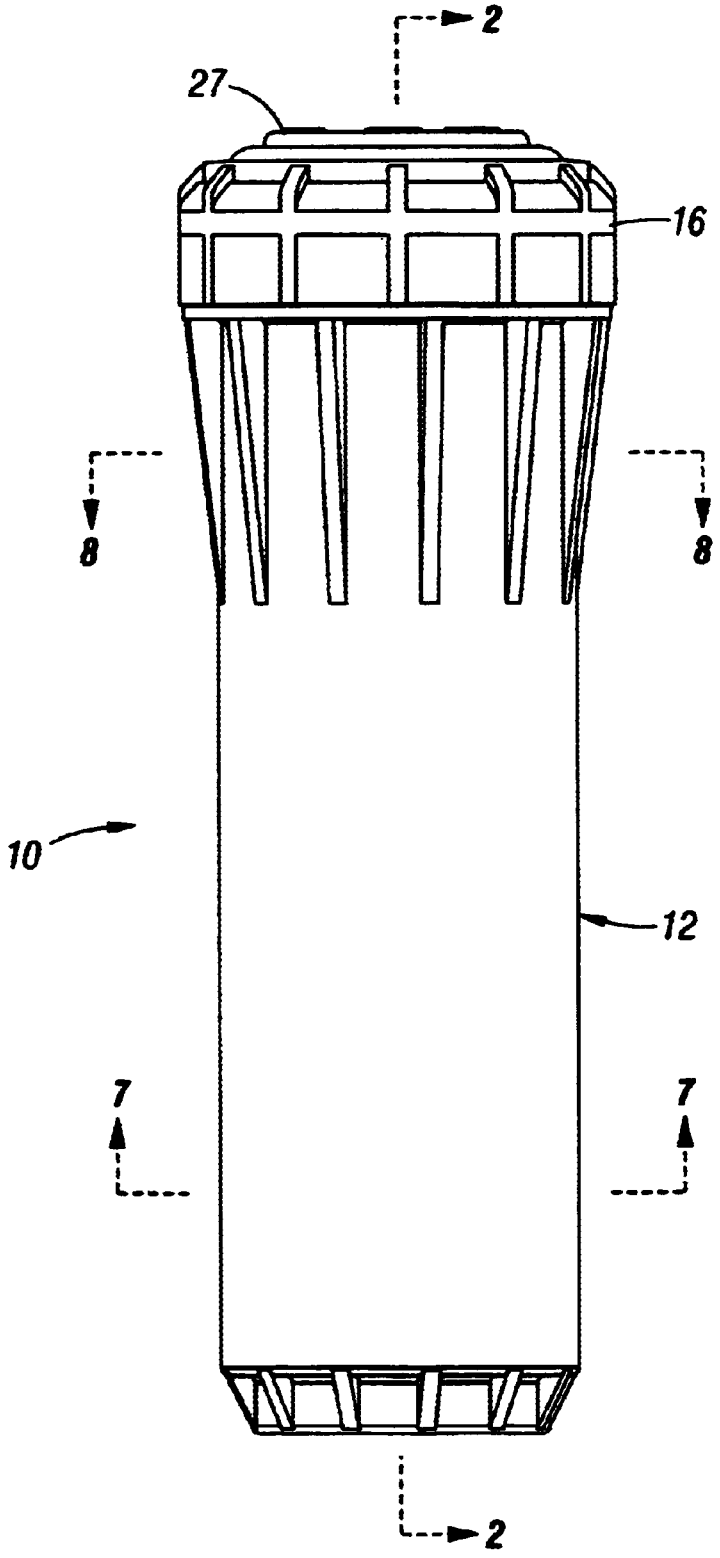
FIG. 1 is a side elevation view of a rotor type sprinkler in accordance with the preferred embodiment of the present invention.
Figure 82:
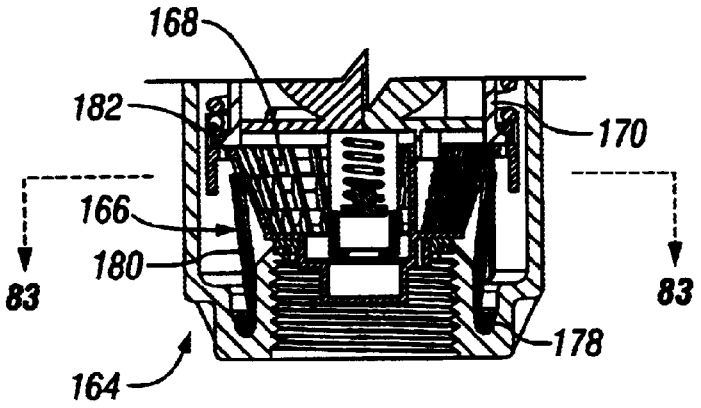
FIG. 82 is a fragmentary vertical sectional view of the lower end of an alternate embodiment of the sprinkler of the present invention taken along line 82—82 of FIG. 90 illustrating its bi-level strainer and scrubber.
Figure 83:
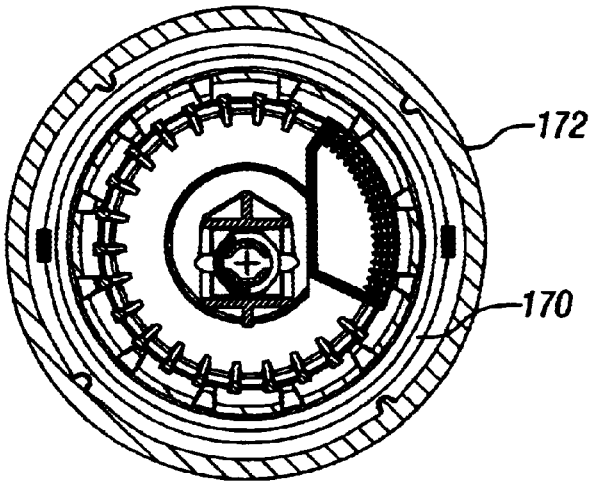
FIG. 83 is a horizontal cross-sectional view taken along line 83—83 of FIG. 82.
Figure 84:
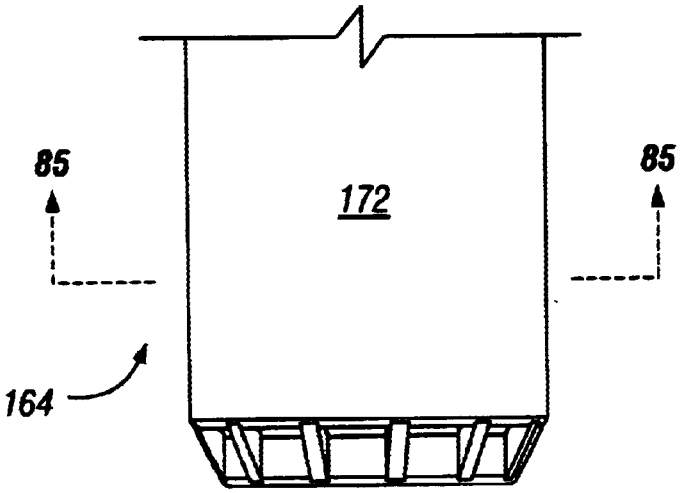
FIG. 84 is a side elevation view of the lower end of the alternate sprinkler embodiment illustrated in FIG. 82.
Figure 85:
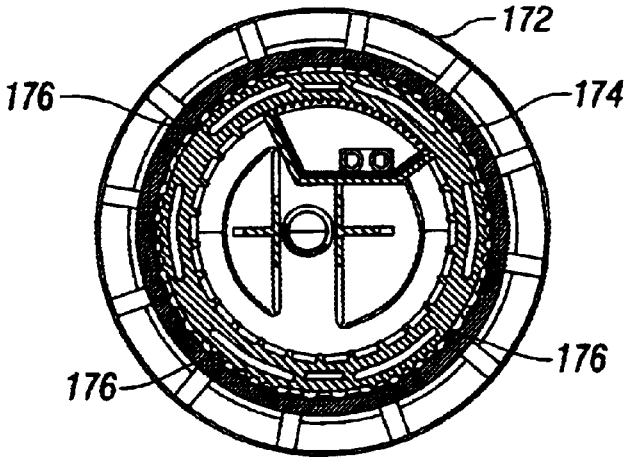
FIG. 85 is a cross-sectional view taken along line 85—85 of FIG. 84.
Figure 86:
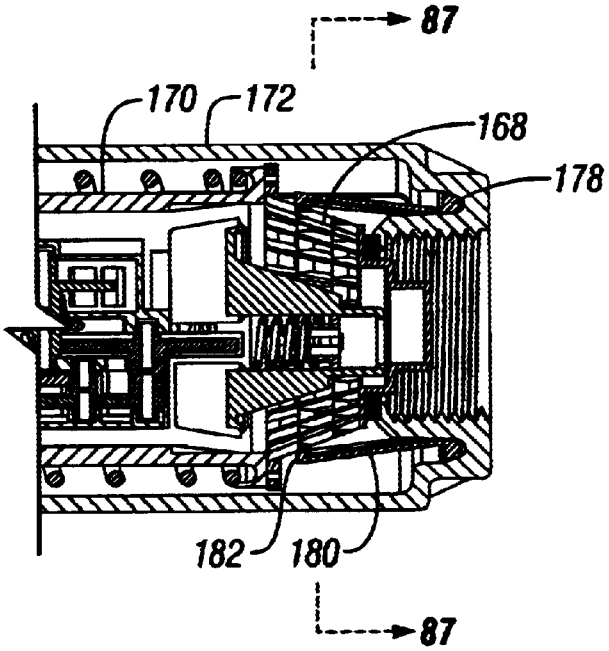
FIG. 86 is a vertical sectional view of the alternate embodiment of the sprinkler taken along line 86—86 of FIG. 89.
Figure 87:
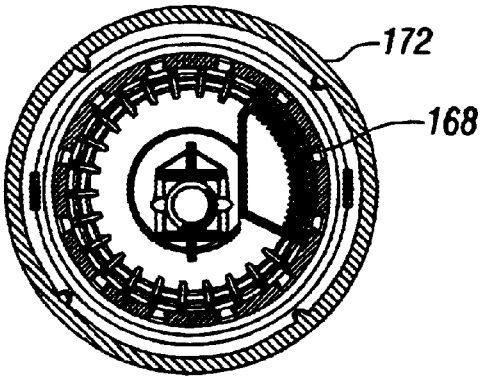
FIG. 87 is a horizontal sectional view of the lower end of the alternate embodiment taken along line 87—87 of FIG. 86.
Figure 92:
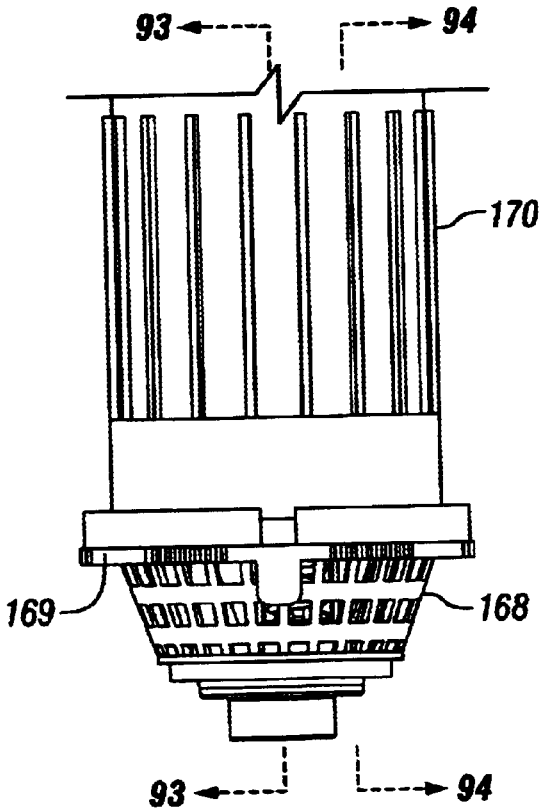
FIG. 92 is a fragmentary side elevation view of the lower end of the riser of the alternate embodiment of the sprinkler showing its ribbed inner cylindrical housing and rotated ninety degrees about a vertical axis from the view of FIG. 91.
Figure 93:
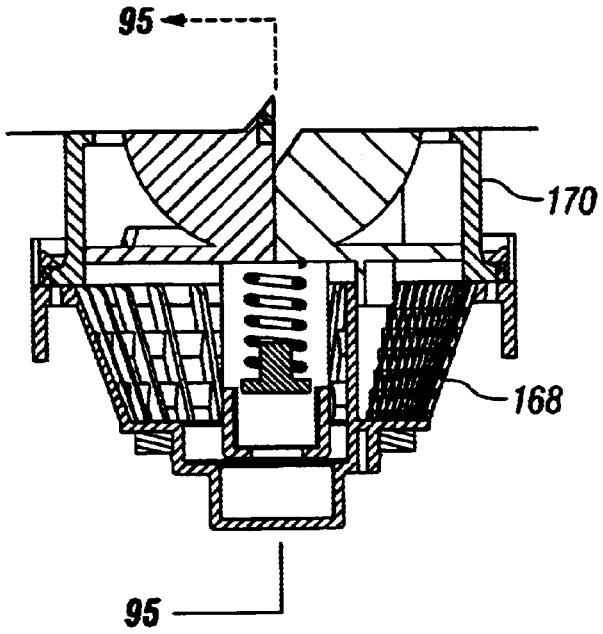
FIG. 93 is a vertical sectional view taken along line 93—93 of FIG. 92.
Figure 94:
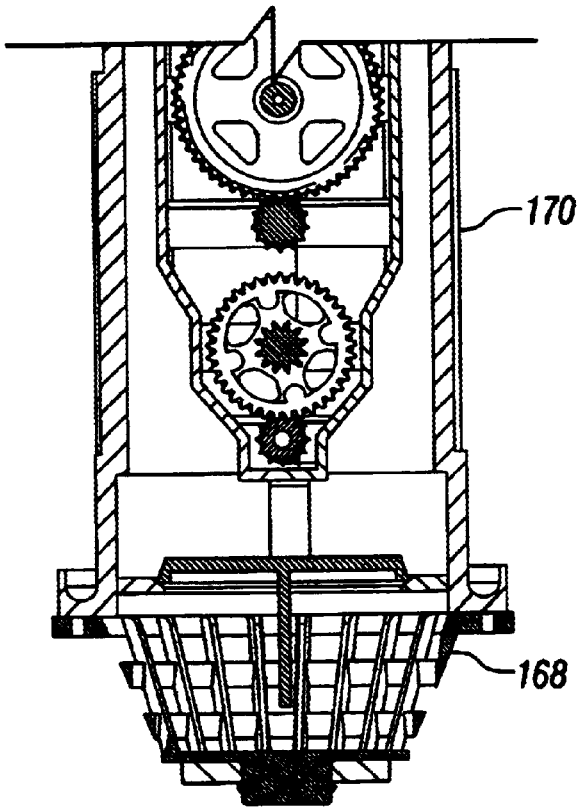
FIG. 94 is a vertical sectional view taken along line 94—94 of FIG. 92.
Figure 95:
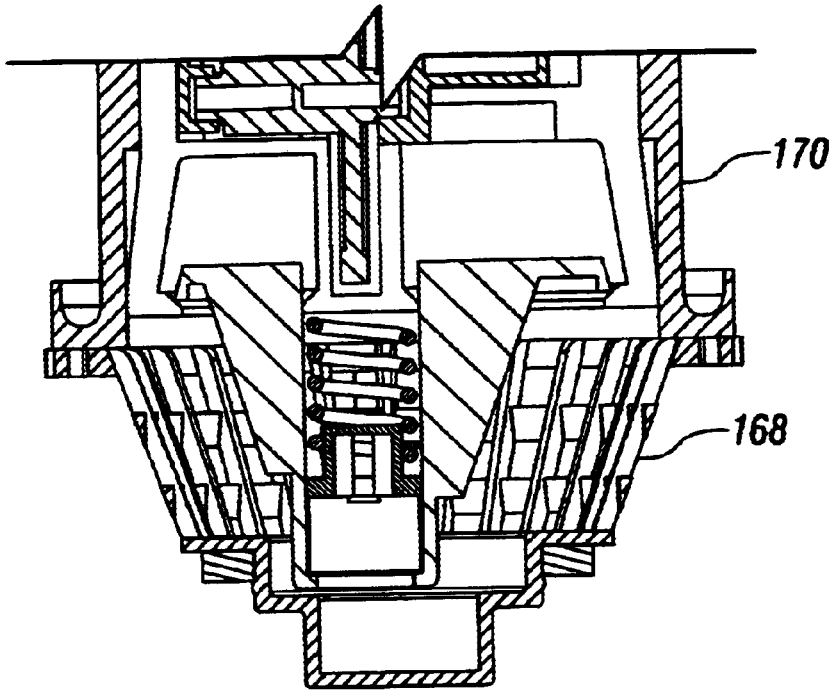
FIG. 95 is a vertical sectional view taken along line 95—95 of FIG. 93.
Figure 96:
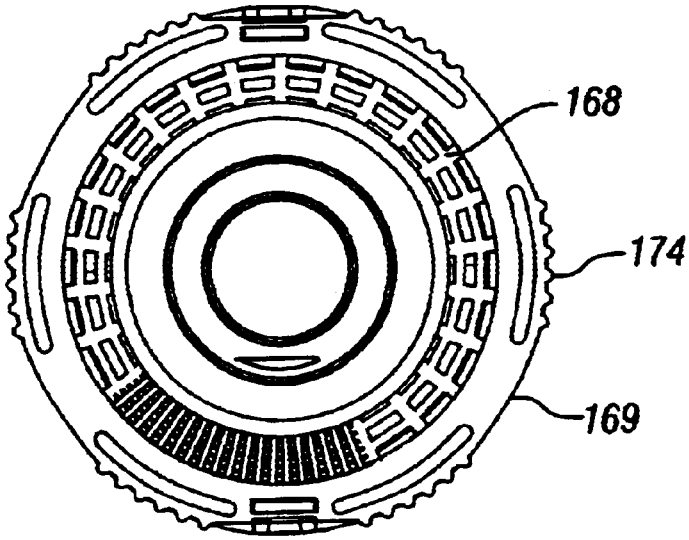
FIG. 96 is a bottom plan view of the riser of the alternate embodiment of the sprinkler taken from the lower end of FIG. 92.

FIGS. 82–96 illustrate an alternate embodiment 164 of our sprinkler which is similar to the sprinkler 10 of FIGS. 1–81 except that the sprinkler 164 has a scrubber 166 (FIG. 82) that scrapes and cleans dirt, algae and other debris off of a bi-level screen or strainer 168 each time the inner riser 170 vertically extends and retracts. In addition, the inner riser 170 of the sprinkler 164 incorporates a novel ratchet mechanism that allows normally fixes the rotational position of the inner riser 170 within the outer housing 172 but permits the inner riser 170 to be rotated relative to the outer housing 172 to orient the selected arc over the desired area of coverage. The bi-level strainer 168 is formed with a integral ratchet projections in the form of a plurality of rounded projections or teeth 174 (FIGS. 85 and 96) on an upper ring portion 169 (FIG. 92) thereof. Due to the resilient flexible construction of the strainer 168 the teeth 174 can deflect radially inwardly past mating vertical ribs 176 (FIG. 85) molded on the interior wall of the outer housing 172. This permits the inner riser 170 to be rotated to a fixed position and maintain that position after arc adjustment.

The scrubber 166 (FIG. 82) has a vertically split frusto-conical configuration. The lower end of the scrubber 166 has an annular ring 178 (FIG. 82) that snaps into a conformably shaped annular recess in the lower end of the outer housing 172. The scrubber 166 has multiple vertically extending slits defining resilient arms 180 (FIGS. 82 and 86) each provided at its upper end with a curved wiper blade 182. The arms 180 firmly press the blades 182 against the strainer 168 as the riser 170 extends and retracts.

While we have described a preferred embodiment of our rotor type sprinkler with an adjustable stator, it will be apparent to those skilled in the art that our invention can be modified in both arrangement and detail. Therefore the protection afforded our invention should only be limited in accordance with the scope of the following claims:

What is claimed is:

1. A sprinkler, comprising:

an outer housing having a lower end connectable to a source of pressurized water;

a riser vertically reciprocable along a vertical axis within the outer housing between extended and retracted positions when the source of pressurized water is turned ON and OFF;

a nozzle mounted at an upper end of the riser for rotation about the vertical axis;

a turbine mounted for rotation at different speeds inside the riser in response to changes in pressure of water flowing past the turbine;

a drive mechanism connecting the turbine and the nozzle for rotating the nozzle; and an adjustable stator for changing the pressure of the water flowing past the turbine to vary the speed of rotation of the nozzle, wherein the adjustable stator includes at least one valve member, a spring for biasing the valve member toward an inlet opening at a lower end of the riser, and means for changing a downward biasing force of the spring exerted against the valve member, wherein the stator includes a frame portion connected to the valve member, wherein the means for changing the downward biasing force includes a mandrel mounted to the frame portion for holding one end of the spring, a vertical position of the mandrel within the frame portion being adjustable, and wherein the mandrel and the frame portion are formed with a plurality of mating detents and projections that allow the mandrel to be twisted and moved to one of a plurality of predetermined vertical positions.

2. The sprinkler of claim 1 wherein the mandrel has a slot for receiving the tip of a tool to enable twisting of the mandrel.

3. The sprinkler of claim 1 wherein the adjustable stator is mounted to a lower end of the riser.

4. The sprinkler of claim 1 wherein the adjustable stator is mounted within a drive subassembly mounted in the riser.

5. A sprinkler, comprising:

a riser;

a turbine mounted in the riser for rotation at different speeds inside the riser in response to changes in pressure of water flowing past the turbine;

a drive mechanism connecting the turbine and a nozzle rotatably mounted at an upper end of the riser for rotating the nozzle; and an adjustable stator for changing the pressure of the water flowing past the turbine to vary the speed of rotation of the nozzle, wherein the adjustable stator includes at least one valve member, a spring for biasing the valve member toward an inlet opening at a lower end of the riser, and means for changing a downward biasing force of the spring exerted against the valve member.

6. The sprinkler of claim 5 wherein the stator includes a frame portion connected to the valve member.

7. The sprinkler of claim 6 wherein the means for changing the downward biasing force includes a mandrel mounted to the frame portion for holding one end of the spring, a vertical position of the mandrel within the frame portion being adjustable.

8. The sprinkler of claim 7 wherein the mandrel and the frame portion are formed with a plurality of mating detents and projections that allow the mandrel to be twisted and moved to one of a plurality of predetermined vertical positions.

9. The sprinkler of claim 7 wherein the mandrel has a slot for receiving the tip of a tool to enable twisting of the mandrel.

10. The sprinkler of claim 5 the adjustable stator extends partially within a drive subassembly mounted in the riser.

11. The sprinkler of claim 5 wherein the wherein the adjustable stator includes a vertical box-like frame portion and a pair of spaced apart valve members extending horizontally from opposite sides of an upper end of the frame portion, a coil spring having an upper end constrained by a stop, and a mandrel mounted to a lower end of the frame portion for holding a lower end of the spring, a vertical position of the mandrel within the frame portion being adjustable for changing a downward biasing force of the spring exerted against the valve members.

12. A sprinkler, comprising:

an outer housing having a lower end connectable to a source of pressurized water;

a riser vertically reciprocable along a vertical axis within the outer housing between extended and retracted positions when the source of pressurized water is turned ON and OFF;

a nozzle mounted at an upper end of the riser for rotation about the vertical axis;

a turbine mounted for rotation at different speeds inside the riser in response to changes in pressure of water flowing past the turbine;

a drive mechanism connecting the turbine and the nozzle for rotating the nozzle; and an adjustable stator for changing the pressure of the water flowing past the turbine to vary the speed of rotation of the nozzle, including a vertical box-like frame portion and a pair of spaced apart valve members extending horizontally from opposite sides of an upper end of the frame portion, a coil spring having an upper end constrained by a stop, and a mandrel mounted to a lower end of the frame portion for holding a lower end of the spring, a vertical position of the mandrel within the frame portion being adjustable for changing a downward biasing force of the spring exerted against the valve members.

13. A sprinkler, comprising:

an outer housing;

a riser reciprocable up and down within the housing;

a turbine mounted in the riser for rotation at different speeds inside the riser in response to water flowing past the turbine;

a drive mechanism connecting the turbine and a nozzle mounted at an upper end of the riser for rotating the nozzle; and an adjustable stator for changing the speed of rotation of the nozzle, including at least one valve member, a spring for biasing the valve member toward an inlet opening at a lower end of the riser, and means for changing a downward biasing force of the spring exerted against the valve member.

14. The sprinkler of claim 13 wherein the stator includes a frame portion connected to the valve member.

15. The sprinkler of claim 13 wherein the adjustable stator extends partially within a drive subassembly mounted in the riser.

16. The sprinkler of claim 13 wherein the wherein the adjustable stator includes a vertical box-like frame portion and a pair of spaced apart valve members extending horizontally from opposite sides of an upper end of the frame portion, a coil spring having an upper end constrained by a stop, and a mandrel mounted to a lower end of the frame portion for holding a lower end of the spring, a vertical position of the mandrel within the frame portion being adjustable for changing a downward biasing force of the spring exerted against the valve members.

* * * * *